US006652964B1

(12) United States Patent
Kato et al.

(10) Patent No.: US 6,652,964 B1
(45) Date of Patent: Nov. 25, 2003

(54) POLYESTER FIBER AND FABRIC PREPARED THEREFROM

(75) Inventors: Jinichiro Kato, Nobeoka (JP); Katsuhiro Fujimoto, Nobeoka (JP)

(73) Assignee: Asahi Kasei Kabushiki Kaisha, Osaka (JP)

( * ) Notice: Subject to any disclaimer, the term of this patent is extended or adjusted under 35 U.S.C. 154(b) by 0 days.

(21) Appl. No.: 09/485,938

(22) PCT Filed: Aug. 18, 1998

(86) PCT No.: PCT/JP98/03660

§ 371 (c)(1),
(2), (4) Date: Feb. 18, 2000

(87) PCT Pub. No.: WO99/09238

PCT Pub. Date: Feb. 25, 1999

(30) Foreign Application Priority Data

| | | |
|---|---|---|
| Aug. 18, 1997 | (JP) | 9-235492 |
| Aug. 20, 1997 | (JP) | 9-223796 |
| Aug. 22, 1997 | (JP) | 9-225923 |
| Sep. 10, 1997 | (JP) | 9-245301 |

(51) Int. Cl.[7] ..... D02G 3/02; C08G 63/02; C08G 63/688; D01F 6/62

(52) U.S. Cl. ..... 428/364; 428/365; 528/272; 528/293

(58) Field of Search ..... 428/364, 365; 528/272, 293

(56) References Cited

U.S. PATENT DOCUMENTS

| | | | | |
|---|---|---|---|---|
| 3,671,379 A | | 6/1972 | Evans et al. | 161/173 |
| 3,900,527 A | | 8/1975 | King et al. | 260/75 S |
| 4,025,492 A | | 5/1977 | Binsack et al. | 260/75 R |
| 4,377,682 A | | 3/1983 | Ohguchi et al. | 528/301 |
| 5,782,935 A | | 7/1998 | Hirt et al. | 8/512 |
| 6,242,558 B1 | * | 6/2001 | Kelsey | 528/206 |
| 6,277,947 B1 | * | 8/2001 | Kelsey et al. | 528/279 |
| 6,284,370 B1 | * | 9/2001 | Fujimoto et al. | 428/364 |
| 6,316,101 B2 | * | 11/2001 | Kato et al. | 428/364 |
| 6,423,814 B1 | * | 7/2002 | Kato et al. | 528/272 |
| 6,503,623 B1 | * | 1/2003 | Oue et al. | 428/364 |
| 6,509,438 B2 | * | 1/2003 | Kelsey et al. | 528/279 |
| 6,512,080 B2 | * | 1/2003 | Kelsey et al. | 528/279 |
| 2001/0003618 A1 | * | 6/2001 | Kato et al. | 428/395 |
| 2001/0029289 A1 | * | 10/2001 | Kelsey et al. | 528/279 |
| 2002/0009353 A1 | * | 1/2002 | Kelsey et al. | 412/40 |
| 2002/0028909 A1 | * | 3/2002 | Kelsey et al. | 528/279 |
| 2002/0119311 A1 | * | 8/2002 | Fujimoto et al. | 428/364 |
| 2003/0050429 A1 | * | 3/2003 | Kato et al. | 528/272 |
| 2003/0065105 A1 | * | 4/2003 | Kato et al. | 525/418 |
| 2003/0092874 A1 | * | 5/2003 | Okajima et al. | 528/272 |

FOREIGN PATENT DOCUMENTS

| | | |
|---|---|---|
| JP | 52-5320 | 2/1975 |
| JP | 57-666119 | 4/1982 |
| JP | 05-230713 | 9/1993 |
| JP | 5-302211 A | 11/1993 |
| JP | 07-070856 A | 3/1995 |
| JP | 08-269820 A | 10/1996 |
| JP | 9-509225 | 9/1997 |

OTHER PUBLICATIONS

Patent Abstracts of Japan translation of JP 05–302211.*

* cited by examiner

*Primary Examiner*—Cheryl A. Juska
(74) *Attorney, Agent, or Firm*—Finnegan, Henderson, Farabow, Garrett & Dunner, L.L.P.

(57) ABSTRACT

A polyester fiber is disclosed, comprising a polyester obtained by copolymerizing a third component with poly (trimethylene terephthalate) wherein the third component is an ester-forming sulfonate compound in a copolymerizing ratio of from 0.5 to 5 mol %, the fiber has a peak temperature of loss tangent of from 85 to 115° C., and the relationship between modulus Q (g/d) and elastic recovery R (%) of the fiber satisfies the following formula (1): $0.18 \leqq Q/R \leqq 0.45$. This fiber can be dyed into a dark shade under atmospheric pressure and enables fast dyeing of a fabric using the fiber in composite with a stretch fiber represented by polyurethane elastic fiber or a fiber material having low heat resistance such as wool silk and acetate fiber. The composite fabric can be dyed under atmospheric pressure, therefore, the physical properties of fiber having low heat resistance used in combination is not impaired during the dyeing process.

The polyester fiber of the present invention can be treated for caustic reduction, therefore, a fiber having highly soft and dry touch and dyeability into brilliant color can be obtained.

14 Claims, No Drawings

POLYESTER FIBER AND FABRIC PREPARED THEREFROM

TECHNICAL FIELD

The present invention relates to a poly(trimethylene terephthalate)-base fiber and, more specifically, to a poly (trimethylene terephthalate)-base fiber dyeable into a dark shade by either one or both of a cationic dye and a disperse dye under atmospheric pressure, and also relates to a fabric using the fiber.

BACKGROUND ART

The poly(trimethylene terephthalate) fiber is an epoch-making fiber having all at the same time a soft touch attributable to the low modulus, the excellent elastic recovery analogous to a nylon fiber, and properties analogous to a poly(ethylene terephthalate) fiber, such as a wash-and-wear property, dimensional stability and good color fastness. By, virtue of these properties, the poly(trimethylene terephthalate) fiber is being applied to clothing, carpets and the like.

However, the poly(trimethylene terephthalate) fiber has a problem in the dyeability. That is, known poly(trimethylene terephthalate) fibers have a problem in their dyeing because the dye is limited to a disperse dye and dyeing into dark shade can be attained only at a high temperature of from 110 to 120° C.

The dye which can dye the fiber is limited to a disperse dye and this means that the resulting dyed product is low in the brilliance and slightly inferior in the color fastness against dry cleaning solvent, abrasion in wet state, dye sublimation and the,like.

The temperature for attaining the dyeing into dark shade is from 110 to 120° C. and this means that composite fiber fabric with other fibers which thermally decompose at the above-described high temperatures cannot be dyed. For example, by compounding the poly(trimethylene terephthalate) fiber with other fiber such as polyurethane elastic fiber, wool, silk or acetate fiber, a blend fabric having softness and touch unattainable by conventional techniques can be obtained. However, these other fibers have a problem in that when the temperature exceeds 110° C. at the dyeing stage, the fiber greatly decreases in the tenacity or loses transparency and turns white, and thereby the commercial value is seriously impaired.

These problems can be overcome if a poly(trimethylene terephthalate) fiber dyeable into dark shade with either one or both of a cationic dye and a disperse dye under atmospheric pressure is found, however, such a fiber has heretofore been not known.

Within the range of conventional techniques, a technique for rendering a poly(trimethylene terephthalate) fiber dyeable with a dye other than a disperse dye for example, a cationic dye, is not known at all.

For increasing the cationic dye dyeability of a polyester fiber including poly(ethylene terephthalate), a method of copolymerizing a polyester by adding thereto a sulfonic acid metal salt group or an isophthalic acid having a quaternary phosphonium sulfonate group before the completion of the polycondensation reaction (see, Japanese Examined Patent Publication (Kokoku) Nos. 34-10497, 47-22334 and 5-230113) is known, though its application to a poly (trimethylene terephthalate) fiber is not specifically described. However, the fiber obtained as such is not dyeable with a cationic dye under atmospheric pressure and has high modulus, therefore, only a fabric having rigid and stiff touch can be obtained. For imparting cationic dye dyeability under atmospheric pressure, it is known to use in the poly(ethylene terephthalate), a dicarboxylic acid such as adipic acid and isophthalic acid or an alkyl ester thereof as a copolymerizing component together with an isophthalic acid having a sulfonic acid metal salt group (see, for example, Japanese Unexamined Patent Publication (Kokai) No. 57-66119). However, the fiber obtained as such also has high modulus and only a fabric having stiff touch can be obtained.

As a fiber having good dyeability with a disperse dye and having low modulus and excellent elastic recovery, for example, a poly(trimethylene terephthalate) fiber disclosed in Japanese Patent Publication (Kokai) No. 52-5320 is known. Furthermore, a method of dyeing a poly (trimethylene terephthalate) fiber using a disperse dye under atmospheric pressure is disclosed in Japanese Unexamined International Publication (Kohyo) No. 9-509225. However, these fibers cannot be dyed at all with a cationic dye under atmospheric pressure. The present inventors have particularly studied thereon and, as a result, have found that in these techniques disclosed in the above-described known arts, the dyeing with a disperse dye under atmospheric pressure can be performed only with a very low dye concentration For example, the dye concentration used in Examples of Japanese Unexamined International Publication (Kohyo) No. 9-509225 is at most 0.5% owf (the unit "% owf" as used herein is a dye concentration in the dye solution shown by the wt % of dyed fabric). In the field of clothing, a fabric dyed into dark shade is demanded similarly to fabrics dyed into light or medium shade. In such dyeing into dark shade, the dye concentration must be 4% owf or more and in some cases, 10% owf or more. However, in the dyeing of a poly(trimethylene terephthalate) fiber, sufficiently high dye exhaustion cannot be attained under atmospheric pressure and therefore, the fiber cannot be dyed into a dark shade.

DISCLOSURE OF THE INVENTION

One object of the present invention is to provide a poly(trimethylene terephthalate)-based fiber dyeable into a dark shade under atmospheric pressure using either one or both of a cationic dye and a disperse dye.

Another object of the present invention is to provide a poly(trimethylene terephthalate)-based fiber capable of giving a composite fiber product in blend or in union with polyurethane elastic fiber, wool, silk, acetate fiber or the like, which can be dyed without impairing the physical properties of the fiber combined having relatively low heat resistance.

Still another object of the present invention is to provide a union woven fabric, blend yarn fabric or union knitted fabric composed of a poly(trimethylene terephthalate)-based fiber capable of fast dyeing under atmospheric pressure in combination with other fiber material.

One specific object of the present invention includes providing a fabric made of a blend of a polyurethane elastic fiber and a poly(trimethylene terephthalate)-based fiber, which can be fast dyed by a simple method using an atmospheric dyeing facility in common use.

The present inventors have found that the above-described objects can be attained by a polyester fiber prepared using, as the polymer, poly(trimethylene terephthalate) with which a specific third component is copolymerized at a specific copolymerizing ratio, such that the fiber has a peak temperature of loss tangent, a modulus and an elastic recovery each falling within an extremely limited range. The present invention has been accomplished based on this finding.

More specifically, the present invention first provides a fiber comprising a polyester obtained by copolymerizing a third component with poly(trimethylene terephthalate), and also provides a fabric using the polyester fiber, wherein the third component is an ester-forming sulfonate compound in a copolymerizing ratio of from 0.5 to 5 mol %, the fiber has a peak temperature of loss tangent of from 85 to 115° C., and the modulus Q (g/d) and the elastic recovery R (%) of the fiber satisfy the following formula (1):

$$0.18 \leqq Q/R \leqq 0.45 \quad (1)$$

Second, the present invention provides a fiber comprising a polyester obtained by copolymerizing a third component with poly(trimethylene terephthalate), and also provides a fabric using the polyester fiber, wherein the third component is at least one selected from the group consisting of (1) an aliphatic or alicyclic glycol having from 4 to 12 carbon atoms in a copolymerizing ratio of from 1.5 to 12 wt %, (2) an aliphatic or alicyclic dicarboxylic acid having from 2 to 14 carbon atoms or isophthalic acid in a copolymerizing ratio of from 3 to 9 wt %, and (3) a poly(alkylene glycol) in a copolymerizing ratio of from 3 to 10 wt %, the fiber has a peak temperature of loss tangent of from 85 to 102° C., and the modulus Q (g/d) and the elastic recovery R (%) of the fiber satisfy the following formula (1):

$$0.18 \leqq Q/R \leqq 0.45 \quad (1)$$

The polymer constituting the polyester fiber of the present invention is a polyester obtained by copolymerizing a specific amount of third component with poly(trimethylene terephthalate). The "poly(trimethylene terephthalate)" as used herein means a polyester consisting of a terephthalic acid as the acid component and a trimethylene glycol (also called 1,3-propanediol) as the diol component.

When a specific amount of ester-forming sulfonate compound is used as the third component copolymerized, a fiber dyeable with a cationic dye under atmospheric pressure can be obtained. When at least one selected from the group consisting of (1) an aliphatic or alicyclic glycol having from 4 to 12 carbon atoms, (2) an aliphatic or alicyclic dicarboxylic acid having from 2 to 14 carbon atoms or isophthalic acid, and (3) a poly(alkylene glycol) is copolymerized in a specific amount, a fiber dyeable with a disperse dye under atmospheric pressure can be obtained.

Examples of the ester-forming sulfonate compound for use in the present invention include a sulfonate group-containing compound represented by the following formula:

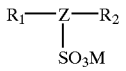

wherein $R_1$ and $R_2$, which may be the same or different, each represents —COOH, —COOR, —OCOR, $—(CH_2)_nOH$, $—(CH_2)_n[O(CH_2)_m]_pOH$ or $—CO[O(CH_2)_n]_mOH$ (wherein R represents an alkyl group having from 1 to 10 carbon atoms, and n, m and p is an integer of 1 or more); M represents a metal, $NH_4$ or a phosphonium group represented by the formula: $—PR_3R_4R_5R_6$ (wherein $R_3$, $R_4$, $R_5$ and $R_6$, which may be the same or different, each represents hydrogen atom or a group selected from the group consisting of an alkyl group, an aryl group and a hydroxyalkyl group, preferably an alkyl group having from 1 to 10 carbon atoms), and when M is a metal, M is preferably an alkali metal or an alkaline earth metal; and Z represents a trivalent organic group, preferably a trivalent aromatic group.

By copolymerizing such an ester-forming sulfonate compound, a fiber dyeable into a dark shade with a cationic dye under atmospheric pressure can be obtained. Also, this fiber is easily dyeable with a disperse dye as compared with a poly(trimethylene terephthalate) homopolymer fiber. The term "dyeable under atmospheric pressure" as used in the present invention means that the dye exhaustion by fiber can reach about 70% or more at 95° C.

This cationic dye dyeable yarn has an appropriate caustic reduction property, therefore, a more soft touch can also be obtained by applying thereto a caustic reduction treatment after weaving or knitting. The term "caustic reduction treatment" as used herein means heating of a fabric in an alkali aqueous solution to dissolve a part of the polymer on the fiber surface. Also, the term "appropriate caustic reduction property" means that the amount or rate of caustic reduction can be industrially controlled. This is an amazingly important feature. For example, a cationic dye dyeable poly (ethylene terephthalate) fiber is excessively high in the caustic reduction rate and cannot be substantially controlled in industry. However, the caustic reduction rate of the polyester fiber of the present invention is on the same level as that of an ordinary poly(ethylene terephthalate) fiber which is not cationic dye dyeable, and the caustic reduction treatment thereof can be performed by a known method. The thus treated polyester fiber of the present invention can be characterized in that the touch is more soft and, due to the presence of microscopic pores of about a few $\mu$m on the fiber surface, a dry feeling is also present and dyeing in more brilliant color can be attained.

Specific examples of preferred ester-forming sulfonate compounds include 5-sodium sulfoisophthalate, 5-potassium sulfoisophthalate, 4-sodium sulfo-2,6-naphthalenedicaboxylate, 2-sodium sulfo-4-hydroxybenzoate, tetramethylphosphonium 3,5-dicarboxybenzene sulfonate, tetrabutylphosphonium 3,5-dicarboxybenzene sulfonate, tributylmethylphosphonium 3,5-dicarboxybenzene sulfonate, tetrabutylphosphonium 2,6-dicarboxynaphthalene-4-sulfonate, tetramethylphosphonium 2,6-dicarboxynaphthAlene-4-sulfonate, ammonium 3,5-dicarboxybenzene sulfonate, and ester derivatives thereof, such as methyl, dimethyl and ester. In particular, ester derivatives thereof, such as methyl and dimethyl ester, are preferred in view of the whiteness of polymer and the polymerization rate.

The copolymerizing ratio of the ester-forming sulfonate compound to the poly(trimethylene terephthalate) must be from 0.5 to 5 mol % based on the total molar number of all acid components. If the copolymerizing ratio of ester-forming sulfonate compound is less than 0.5 mol %, the fiber cannot be dyed with a cationic dye under atmospheric pressure, whereas if the ratio of the ester-forming sulfonate compound exceeds 5 mol %, the polymer deteriorates in the heat resistance and seriously deteriorates in the polymerizability and spinnability, and additionally, the fiber readily loses the whiteness. From the standpoint of satisfying both the polymerizability and the spinnability while maintaining the sufficiently high dyeability with a cationic dye, the copolymerizing ratio of the ester-forming sulfonate compound is preferably from 1 to 3 mol %, more preferably from 1.2 to 2.5 mol %.

Specific examples of the aliphatic glycol and the alicyclic glycol each having from 4 to 12 carbon atoms include 1,2-butane diol, 1,3-butane diol, 1,4-butane diol, neopentyl glycol, 1,5-pentamethylene glycol, 1,6-hexamethylene glycol, heptamethylene glycol, octamethylene glycol, decamethylene glycol, dodecamethylene glycol, 1,4-cyclohexane diol, 1,3-cyclohexane diol, 1,2-cyclohexane diol, 1,4-cyclohexane dimethanol, 1,3-cyclohexane dimethanol and 1,2-cyclohexane dimethanol. By copolymerizing such a glycol with poly(trimethylene terephthalate), dyeing into dark shade using a disperse dye under atmospheric pressure can be attained. Among these aliphatic and alicyclic glycols, 1,4-butane diol, 1,6-hexamethylene glycol, neopentyl glycol and cyclohexane dimethanol are preferred because the polymer can have excellent properties with respect to whiteness, thermal decomposability and color fastness to light. In view of high polymerization rate and good color fastness to dry cleaning solvent, 1,4-butane diol is more preferred.

The copolymerizing ratio of the glycol to the poly (trimethylene terephthalate) must be from 1.5 to 12 wt % based on the weight of polymer. If the copolymerizing ratio is less than 1.5 wt %, the fiber cannot be dyed with a cationic dye under atmospheric pressure. The copolymerizing ratio of glycol is greatly correlated with the modulus, modulus recovery, melting point, glass transition point and dyeability. If the copolymerizing ratio exceeds 12 wt %, the melting point or glass transition point largely decreases and the touch turns hard at the stage of after-working represented by heatsetting or in the ordinary use represented by ironing, or the fabric after dyeing is disadvantageously reduced in the color fastness to dry cleaning solvent. The copolymerizing ratio of glycol is preferably from 2 to 10 wt %, more preferably from 3 to 7 wt %.

Specific examples of the aliphatic or alicyclic dicarboxylic acid having from 2 to 14 carbon atoms for use in the present invention include oxalic acid, malonic acid, succinic acid, glutaric acid, adipic acid, heptanoic diacid, octanoic diacid, sebacic acid, dodecanoic diacid, 2-methylglutaric acid, 2-methyladipic acid, fumaric acid, maleic acid, itaconic acid, 1,4-cyclohexanedicarboxylic acid, 1,3-cyclohexnedicarboxylic acid and 1,2-cyclohexanedicarboxylic acid. By copolymerizing such a dicarboxylic acid with poly(trimethylene terephthalate), dyeing into dark shade using a disperse dye under atmospheric pressure can be attained.

Among these aliphatic or alicyclic dicarboxylic acids and isophthalic acid, sebacic acid, dodecanoic diacid, 1,4-cyclohexanedicarboxylic acid and isophthalic acid are preferred because of high polymerization rate at the copolymerization and excellent color fastness to light, and in view of excellent whiteness of polymer, isophthalic acid is more preferred.

The copolymerizing ratio of the aliphatic or alicyclic dicarboxylic acid or the isophthalic acid to the poly (trimethylene terephthalate) must be from 3 to 9 wt % based on the weight of polymer. If the copolymerizing ratio is less than 3 wt %, the fiber cannot be dyed into dark shade under atmospheric pressure, whereas if the copolymerizing ratio exceeds 9 wt %, the melting point or glass transition point excessively decreases and the touch turns hard at the stage of converting processing represented by heatsetting or in the ordinary use represented by ironing, or the fabric after dyeing is disadvantageously reduced in the color fastness to dry cleaning solvent. The copolymerizing ratio of the aliphatic or alicyclic dicarboxylic acid or the isophthalic acid is preferably from 3 to 8 wt %, more preferably from 3 to 7 wt %.

In the present invention, a poly(alkylene glycol) may also be used as the copolymerizing component. In the case where a glycol or an acid is copolymerized as the third component, the melting point inevitably decreases and, as a result, the spinnability deteriorates or the fiber obtained may have bad handleability and undergo melt-adhesion to a heat source or considerable shrinkage due to the heat at the converting processing. In the case where a poly(alkylene glycol) is used as the third component, the melting point scarcely decreases and the above-described problems do not occur. This is considered to be because the poly(alkylene glycol) component has a large molecular weight and therefore, is localized in the polymer. The poly(alkylene glycol) used may be any of poly(ethylene glycol), poly(trimethylene glycol), poly (tetramethylene glycol) and a copolymer thereof, however, in view of heat stability, poly(ethylene glycol) is most preferred.

The poly(alkylene glycol) preferably has an average molecular weight of from 300 to 20,000. If the average molecular weight is less than 300, the poly(alkylene glycol) contained has a fairly low molecular weight and is removed by vacuum distillation at the polymerization under high vacuum and the amount of poly(alkylene glycol) contained in the polymer obtained cannot be constant. As a result, the feed yarns are not uniformalized in the elongation tenacity, dyeability, thermal property and the like, and the products are dispersed in property.

On the other hand, if the average molecular weight exceeds 20,000, a large amount of poly(alkylene glycol) having a high molecular weight remains not copolymerized in the polymer to cause reduction in the dyeability and color fastness to dry cleaning solvent or light. The average molecular weight of poly(alkylene glycol) is preferably from 400 to 10,000, more preferably from 500 to 5,000.

The copolymerizing ratio of poly(alkylene glycol) to the poly(trimethylene terephthalate) must be from 3 to 10 wt % based on the weight of polymer. If the ratio of poly(alkylene glycol) is less than 3 wt %, dyeing into a heavy shade with a disperse dye under atmospheric pressure cannot be attained, whereas if the ratio of poly(alkylene glycol) exceeds 10 wt %, the polymer is reduced in the heat resistance and seriously deteriorates in the polymerizability and spinnability, moreover, the, glass transition excessively decreases and the touch turns hard at the stage of converting processing represented by heat setting or in the ordinary use represented by ironing, or the fabric after dyeing is disadvantageously reduced to a severe extent in the color fastness against dry cleaning solvent or light. The copolymerizing ratio of poly(alkylene glycol) is preferably from 4 to 8 wt %.

In the polymer constituting the polyester fiber of the present invention, a fourth component may also be blended by the copolymerization within the range of not inhibiting the objects of the present invention. Even if a fourth component is used, the above described copolymerizing ratio must be kept so as not to inhibit the objects of the present invention Among these combinations, when the ester-forming sulfonate compound and at least one component selected from the group consisting of (1) an aliphatic or alicyclic glycol having from 4 to 12 carbon atoms, (2) an aliphatic or alicyclic dicarboxylic acid having from 2 to 14 carbon atoms or isophthalic acid, and (3) a poly(alkylene glycol) are copolymerized, a polyester fiber dyeable with both a cationic dye and a disperse dye under atmospheric pressure can be obtained. In this combination, the copolymerizing ratio is preferably such that the ester-forming sulfonate compound is from 1.2 to 2.5 mol % and at least one component selected from (1) to (3) above is from 3 to 7 wt %.

Furthermore, if desired, various additives such as a delustering agent, a thermal stabilizer, an antifoaming agent, a color toning agent, a flame retardant, an antioxidant, an ultra-violet absorbing agent, a crystallization nuclear agent and a fluorescent whitening agent may be copolymerized or mixed in the polyester fiber of the present invention.

The molecular weight of the polyester for use in the present invention can be specified by the intrinsic viscosity. The intrinsic viscosity [η] is preferably from 0.3 to 2.0, more preferably from 0.35 to 1.5, still more preferably from 0.4 to 1.2. With such an intrinsic viscosity, a polyester fiber having high tenacity and excellent spinnability can be obtained. If the intrinsic viscosity is less than 0.3, the polymer becomes unstable in the spinnability due to excessively low polymerization degree and the fiber obtained is not satisfied in the tenacity, whereas if the intrinsic viscosity exceeds 2.0, the melt viscosity is excessively high and, as a result, weighing in the gear pump cannot be smoothly performed and the spinnability decreases due to ejection failure or the like.

The polymer constituting the polyester fiber of the present invention can be fundamentally polymerized by a known method. More specifically, a third component may be added in a conventional production process of poly(trimethylene terephthalate), at any stage during the ester interchange reaction and subsequent polycondensation reaction between a terephthalic acid or a terephthalic acid lower ester such as dimethyl terephthalate and a trimethylene glocol. In this case, the ester-forming sulfonate compound, the aliphatic or alicyclic dicarboxylic acid or the isophthalic acid is preferably added before the ester interchange reaction because the reaction with a trimethylene glycol must be accelerated, and a poly(alkylene glycol) is preferably added after the completion of ester interchange so as to prevent the polymer from losing the whiteness or bumping at the pressure reduction. In the ester interchange, a metal acetate, a titanium alkoxide or the like is preferably used as the catalyst in an amount of from 0.01 to 0.1 wt % because the reaction rate, the whiteness of polymer and the heat stability all can be satisfied. The reaction temperature is approximately from 200 to 240° C. In the polycondensation reaction, an antimony oxide, a titanium alkoxide and the like may be used as the catalyst and in particular, when a titanium alkoxide is used, it can serve also as an ester interchange catalyst. The catalytic amount is, in view of the reaction rate and the whiteness of polymer, from 0.01 to 0.1 wt % based on the total carboxylic acid amount. The reaction temperature is from 240 to 280° C. and the vacuum degree is from 0.001 to 1 torr. The above-described additives may be added at any stage during the polymerization process, however, in order to minimize the reaction inhibition, they are preferably added at any stage after the completion of ester interchange reaction.

The polymer constituting the polyester fiber of the present invention may be increased in the molecular weight by subjecting the polymer obtained by the above-described method to solid state polymerization in an inert gas such as nitrogen or argon or under reduced pressure. When such a technique is applied, the polymer may be prevented from losing the whiteness or the amount of oligomer which gives rise to yarn breaking or broken filaments in yarn may be reduced and the tenacity may be increased. The solid state polymerization may be performed by a known method used, for example, for poly(ethylene terephthalate) as it is, however, the intrinsic viscosity of prepolymer before the solid state polymerization is preferably from 0.4 to 0.8 so as to increase the whiteness, the solid state polymerization temperature is preferably from 170 to 230° C., and the polymerization period, which may vary depending on the desired viscosity, is usually on the order of from 3 to 36 hours.

The polymer constituting the polyester fiber of the present invention may also be produced by blending two kinds of polymers so as to have an objective copolymerized composition. For example, poly(trimethylene terephthalate) having copolymerized therewith 5wt % of 1,4-butanediol may be produced by blending 95 wt % of poly(trimethylene terephthalate) and 5 wt % of polybutylene terephthalate. The "blending" as used herein may be performed by blending the components in a polymerization vessel to allow the ester interchange reaction to satisfactorily proceed and then discharging them or more simply by reacting the components in the chip-blend state in an extruder. Even when such a method is employed, a homogeneous polymer can be obtained because the ester interchange rate is sufficiently high.

In the production method of polymer constituting the polyester fiber of the present invention, an important matter is to maintain the whiteness of polymer. When poly (trimethylene terephthalate) is copolymerized with a third component, coloration is generally liable to occur during the process of polymerization or spinning. For increasing the whiteness, the above-described preferred catalytic amount and reaction temperature are preferably combined with the use of a thermal stabilizer or a coloring inhibitor. The thermal stabilizer is preferably a pentavalent or trivalent phosphorus compound. Examples thereof include trimethyl phosphate, triethyl phosphate, triphenyl phosphate, trimethyl phosphite, triethyl phosphite, triphenyl phosphite, phosphoric acid and phosphorous acid. The thermal stabilizer is preferably added in an amount of from 0.01 to 0.07 wt % based on the polymer. Examples of the coloring inhibitor include cobalt acetate and cobalt formate. The coloring inhibitor is preferably added in an amount of from 0.01 to 0.07 wt % based on the polymer. In the case of elevating the intrinsic viscosity to 0.9 or more, solid state polymerization of the prepolymer is a very effective method for increasing the whiteness. The polymer obtained as such can maintain excellent whiteness even when the polymer is formed into a fiber. The whiteness is, in terms of b value which is described later, from −2 to 10, preferably from −1 to 6.

Here, it should be particularly noted that when an ester-forming sulfonate compound is used, substances prone to cohere to the spinpack and a trimethylene glycol dimer (structural formula: $HOCH_2CH_2CH_2OCH_2CH_2CH_2OH$) are readily produced. If the amount of aggregate is large, the pressure within the spinpack greatly increases and yarn breaking is liable to occur and for preventing it, the spinpack must be exchanged frequently, which disadvantageously reduces the productivity. If the amount of trimethylene glycol dimer is large, the thermal stability at melting or the color fastness to light disadvantageously decreases. In order to overcome these problems, a certain kind of additive is preferably added at an optional stage during the polymerization. Examples of the additive include a basic metal salt such as lithium acetate, lithium carbonate, lithium formate, sodium acetate, sodium carbonate, sodium formate, sodium hydroxide, calcium hydroxide and potassium hydroxide. The amount of the additive added is from 20 to 400 mol %, preferably from 70 to 200 mol %, based on the ester-forming sulfonate compound.

The polyester fiber of the present invention may have either a continuous filament or a staple form. In the case of continuous filament, the fiber may comprise either a multifilament or a monofilament. The total denier is not particularly limited but it is preferably from 5 to 1,000 d and in the case of use for clothing, more preferably from 5 to 200 d. The single yarn denier is also not particularly limited but preferably from 0.0001 to 10 d. The cross-sectional form is also not particularly limited and may be round, triangular, flat, star or w-shaped or the like, and furthermore, may be either solid or hollow.

In the polyester fiber of the present invention, the peak temperature of loss tangent (hereinafter simply referred to as "Tmax") determined by the measurement of dynamic viscoelasticity must be from 85 to 115° C. when the third component is an ester-forming sulfonate compound, and from 85 to 102° C. when the third component is at least one selected from the group consisting of (1) an aliphatic or alicyclic glycol having from 4 to 12 carbon atoms in a copolymerizing ratio of from 1.5 to 12 wt %, (2) an aliphatic or alicyclic dicarboxylic acid having from 2 to 14 carbon atoms or isophthalic acid in a copolymerizing ratio of from 3 to 9 wt %, and (3) a poly(alkylene glycol) in a copolymerizing ratio of from 3 to 10 wt %. Within this range, the cationic and/or disperse dye dyeability under atmospheric pressure and the high color fastness as the goals of the present invention can be ensured. Tmax corresponds to the molecular density in the amorphous area, therefore, the smaller this value is, the smaller the molecular density in the amorphous area is and the larger the gap portion for entry of the dye is, whereby entering of the dye is facilitated and in turn the dye exhaustion increases. Whichever third component is used, if Tmax is less than 85° C., molecules can easily move due to the low temperature and therefore, the touch turns hard due to occurrence of excessively large shrinkage at the stage of converting processing represented by heatsetting or in the ordinary use represented by ironing, or the fabric after dyeing is reduced in the color fastness to dry cleaning solvent. When an ester-forming sulfonate compound is used as the third component, if Tmax exceeds 115° C., the color fastness as an object of the present invention decreases and the gap portion for entering the dye becomes excessively small, then, dyeing into dark shade with a cationic dye under atmospheric pressure cannot be attained. When at least one selected from the group consisting of (1) an aliphatic or alicyclic glycol having from 4 to 12 carbon atoms in a copolymerizing ratio of from 1.5 to 12 wt %, (2) an aliphatic or alicyclic dicarboxylic acid having from 2 to 14 carbon atoms or isophthalic acid in a copolymerizing ratio of from 3 to 9 wt %, and (3) a poly(alkylene glycol) in a copolymerizing ratio of from 3 to 10 wt % is used as the third component, if Tmax exceeds 102° C., the gap portion for entering the dye becomes too small, as a result, dyeing into dark shade with a disperse dye under atmospheric pressure cannot be attained.

The Tmax is a structure factor of the fiber, accordingly, even among polymers having the same copolymerized composition, the value varies depending on the spinning conditions such as spinning temperature, spinning rate, draw ratio, heat treatment temperature, caustic reduction treatment and dyeing conditions, or converting processing conditions. In particular, the Tmax value greatly varies depending on the heat setting temperature, therefore, it is important to control Tmax to fall within the above-described range by changing the heat setting temperature. The way of establishing the heatsetting temperature is roughly described below. In the case of the polyester fiber specified in the present invention, when the heat setting temperature is from room temperature to about 150° C., Tmax gradually increases, however, when the heat setting temperature reaches about 160° C. or more, Tmax subsequently greatly reduces. The changing ratio varies by respective copolymerizing ratios, therefore, studies must be made while examining the relationship between the heat setting temperature and Tmax. In the case of the present invention, if the heat setting temperature exceeds 115° C., the, effect of improving dyeability is small and atmospheric dyeability cannot be attained. On the other hand, if the heat setting temperature is excessively low, the amorphous part becomes too coarse and the dye may easily enter therein but at the same time, disadvantageously come out therefrom with ease. In other words, the color fastness, particularly the color fastness to dry cleaning solvent, color fastness rubbing in wet state or, color fastness to laundering decreases. Furthermore, due to hardening at the heat setting, there arises a problem such as deterioration in the touch or reduction in the dimensional stability. Although slightly vary depending on the kind of third component, the Tmax range is preferably from 97 to 112° C. when an ester-forming sulfonate compound is used as the third component, and from 85 to 102°, more preferably from 90 to 98° C. when at least one selected from the group consisting of (1) an aliphatic or alicyclic glycol having from 4 to 12 carbon atoms in a copolymerizing ratio of from 1.5 to 12 wt %, (2) an aliphatic or alicyclic dicarboxylic acid having from 2 to 14 carbon atoms or isophthalic acid in a copolymerizing ratio of from 3 to 9 wt %, and (3) a poly(alkylene glycol) in a copolymerizing ratio of from 3 to 10 wt % is used as the third component.

In the polyester fiber of the present invention, the modulus Q (g/d) and the elastic recovery R (%) after 20% elongation and subsequent standing for 1 minute must satisfy the following formula (1). When formula (1) is satisfied, the fabric obtained from the polyester fiber of the present invention can have a soft touch comparable or superior to nylon unlike the fabric obtained from a conventional polyester fiber.

$$0.18 \leqq Q/R \leqq 0.45 \quad (1)$$

If Q/R>0.45, due to excessively high modulus, a soft touch comparable to nylon, which is an object of the present invention, cannot be obtained or due to deficient elastic recovery, the fiber once deformed by the application of stress cannot restore to the original shape and the fabric obtained may have only bad shape stability. The region having Q/R<0.18 is substantially not present, therefore, in the present invention, 1.8 is the lower limit of Q/R. To speak specifically, for satisfying formula (1), the modulus is usually from 25 to 40 g/d and the elastic recovery is from 70 to 99%.

In the case of a poly(trimethylene terephthalate) fiber in which an ester-forming sulfonate compound in a copolymerizing ratio of from 1.2 to 2.5 mol % and at least one selected from the group consisting of (1) an aliphatic or alicyclic glycol having from 4 to 12 carbon atoms, (2) an aliphatic or alicyclic dicarboxylic acid having from 4 to 12 carbon atoms or an isophthalic acid, and (3) a poly(alkylene glycol), in a copolymerizing ratio of from 3 to 7 wt % are copolymerized, Tmax of the fiber must be from 85 to 115° C. and the; modulus Q (g/d) and elastic recovery R (%) of the fiber must satisfy formula (1), from the same reasons as the grounds for Tmax and formula (1) described above in detail.

The polyester fiber of the present invention can be obtained by the following method.

The polyester fiber of the present invention can be obtained by melting a polymer dried to a water content of at least 100 ppm, preferably 50 ppm or less, using an extruder or the like and extruding the molten polymer from the spinneret, followed by taking up and subsequently drawing. The term "taking up and subsequently drawing" as used herein means a so-called conventional spinning process where the yarn obtained by spinning is taken up by a bobbin or the like and then drawn using a different separate apparatus, or a so-called spin-draw process where the spinning and the drawing are directly connected, more specifically, the polymer extruded from the spinneret is completely cooled and solidified and then contacted a several turns or more around a first roll rotating at a constant rate so as to completely cut the transmission of tension before and after the roll, and then the yarn is drawn between the first roll and a second roll disposed next to the first roll.

The conventional spinning process as an example is described below.

In the present invention, the spinning temperature at the melt spinning of polymer is suitably from 240 to 320° C., preferably from 240 to 300° C., more preferably from 240 to 280° C. If the spinning temperature is less than 240° C., a stable molten state may hardly be obtained due to the excessively low temperature and the fiber obtained is largely mottled and also fails in having a satisfactorily high tenacity or elongation. If the spinning temperature exceeds 320° C., the thermal decomposition aggressively takes place and the yarn obtained is colored and also fails in having a satisfactorily high tenacity or elongation.

The yarn taking-up rate is not particularly limited but the yarn is usually taken up at 3,500 m/min or less, preferably 2,500 m/min or less, more preferably 2,000 m/min or less. If the taking-up rate exceeds 3,500 m/min, the crystallization proceeds before the taking up and the draw ratio at the drawing step cannot be increased, therefore, the molecules cannot be oriented, as a result, a sufficiently high yarn tenacity or elastic recovery may not be obtained or winding up takes-place to prevent disengaging of a bobbin or the like from the take-up machine. The draw ratio at the drawing is suitably from 2 to 4 times, preferably from 2.2 to 3.7 times, more preferably from 2.5 to 3.5 times. If the draw ratio is less than 2 times, the polymer cannot be satisfactorily oriented by the drawing and the yarn obtained has a low elastic recovery, failing in satisfying formula (1), whereas if it exceeds 4 times, yarn breaking takes place very often and the drawing cannot be stably performed.

The temperature in the drawing zone at the drawing is suitably from 30 to 80° C., preferably from 35 to 70° C., more preferably from 40 to 65° C. If the drawing zone temperature is less than 30° C., yarn breaking occurs very often at the drawing and fibers cannot be continuously obtained, whereas if it exceeds 80° C., the slipping property of fiber to the heating zone such as drawing roll is deteriorated and single yarns are very often broken to give a yarn full of broken filaments, or the polymers slip through from each other and cannot be sufficiently oriented and therefore, the elastic recovery decreases.

In order to prevent the aging change of fiber structure, the yarn after the drawing must be heat treated. The heat treatment temperature is suitably from 90 to 200° C., preferably from 100 to 190°, more preferably from 110 to 180° C. If the heat treatment temperature is less than 90° C., crystallization of the fiber does not proceed satisfactorily and the elastic recovery deteriorates, whereas if the temperature exceeds 200° C., the fiber is broken in the heat treatment zone and cannot be drawn.

The spin-draw process as an example is described below. A molten multifilament extruded from the spinneret is passed through a heat reserving zone in a length of from 2 to 80 cm, which is disposed right below the spinneret and kept at an atmospheric temperature of from 30 to 200° C., to prevent the abrupt cooling. Thereafter, the molten multifilament is abruptly cooled and the resulting solid multifilament is contacted around a first roll heated at from 40 to 70° C. and rotating at a rate of 300 to 3,000 m/min, then without taking it up, is contacted around a second roll heated at from 120 to 160° C. to draw the multifilament to from 1.5 to 3 times between the first roll and the second roll rotating at a higher rate than the first roll, and then taken up using a take-up machine at a rate lower than the second roll. In the spinning process, if desired, an interlacing treatment may be performed. Also, an undrawn yarn once taken up at a spinning rate of from 300 to 3,000 m/min may be taken up through the above-described first and second rolls.

Similarly to the conventional spinning process, it is very preferred that a polymer is melt extruded, the molten multifilament extruded from the spinneret is, without abruptly cooling it, immediately passed through a heat reserving region in a length of from 2 to 80 cm, which is disposed right below the spinneret and kept at an atmospheric temperature of from 30 to 200° C., to suppress abrupt cooling, and then the molten multifilament is abruptly cooled into a solidified multifilament and then subjected to the subsequent drawing step. By the passing through a heat reserving region, the polymer can be prevented from producing of fine crystal or amorphous areas having an extreme orientation ascribable to the abrupt cooling and can form an amorphous structure easy to draw at the drawing step and, as a result, the fiber obtained can have physical properties required in the present invention. The poly(trimethylene terephthalate) has by far a higher crystallization rate compared with a polyester such as poly(ethylene terephthalate), therefore, the above-described gradual cooling is very effective in preventing production fine crystal or amorphous areas having an extreme orientation. If the atmospheric temperature is less than 30° C., abrupt cooling results and the draw ratio is difficult to increase, whereas if it exceeds 200° C., yarn breaking is liable to occur. The temperature in the heat reserving region is preferably from 40 to 200° C., more preferably from 50 to 150° C. The length of heat reserving region is preferably from 5 to 30 cm.

The yarn spinning rate is, in terms of the contacting rate around a first roll, from 300 to 3,000 m/min. If the spinning rate is less than 300 m/min, excellent spinning stability may be attained but the productivity greatly decreases, whereas if it exceeds 3,000 m/min, orientation of the amorphous area or partial crystallization proceeds before the taking up and at the drawing step, the draw ratio cannot be increased and, as a result, the molecules cannot be oriented and a sufficiently high yarn tenacity cannot be obtained. The spinning rate is preferably from 1,500 to 2,700 m/min.

The rate of the take-up machine must be lower than the rate of the second roll so as to relax the orientation in the amorphous area of fiber. By doing so, the poly(trimethylene terephthalate) fiber can be reduced in the large shrinkage and a loose amorphous area results to form a structure facilitating the entering of dye, as a result, the dyeability is improved. The relax ratio (take-up rate/second roll rate) is approximately from 0.95 to 0.99, preferably from 0.95 to 0.98.

The rate of the second roll is determined by the draw ratio but it is usually from 600 to 6,000 m/min. The draw ratio between the first roll and the second roll is suitably from 1.3 to 3 times, preferably from 2 to 2.7 times. If the draw ratio is 1.3 times or less, the polymer cannot be satisfactorily oriented by the drawing and the fiber obtained is low in the tenacity or elastic recovery, whereas if it exceeds 3 times, broken filaments are severely generated in the yarn and the drawing cannot be stably performed. The first roll temperature is from 40 to 70° C. With a temperature in this range, a system capable of easy drawing can be created. The temperature of the second roll on which heat setting is performed is from 120 to 160° C. If the second roll temperature is less than 120° C., the fiber obtained has poor thermal stability, is prone to thermal deformation or aging change and deteriorates in the coloring property, whereas if it exceeds 160° C., broken filaments are generated or yarn breaking occurs and the spinning cannot be stably performed. The second roll temperature is preferably from 120 to 150° C.

For obtaining a fiber having sufficiently high evenness and high quality, it is important to apply the preferred conditions described above for the conventional spinning process and the spin-draw process. As a parameter for evaluating the quality of a fiber obtained by applying the preferred spinning conditions, for example, U % may be used. The U % is a parameter for showing the evenness in the cross section of a fiber. When the preferred conditions are applied, U % is 2.5% or less and, in some cases, 1.5% or less.

The polyester fiber thus obtained is used by itself or as a part of fabric to provide a fabric having excellent properties in the softness, stretchability and coloration. In the case of using the polyester fiber as a part of fabric, the other fiber is not particularly limited. However, when the polyester fiber is used in composite with a fiber such as a stretch fiber represented by polyurethane elastic fiber, a cellulose fiber, wool, silk or an acetate fiber, a characteristic feature incapable of being obtained by a blend fabric using a nylon fiber or a poly(ethylene terephthalate) fiber may be brought out. More specifically, the composite fabric can be dyed using a cationic dye and/or a disperse dye under atmospheric pressure and at the same time, can have a unique touch favored with softness and stretchability which cannot be attained by conventional techniques.

The polyester fiber of the present invention can be dyed into dark shade with a cationic dye or a disperse dye or with both dyes and by virtue of this feature, a polyurethane elastic fiber can be dyed without causing any staining and in turn can have softness and touch different from composite fabrics of a nylon fabric with a stretch fiber represented by a polyurethane elastic fiber. In this point, a particularly preferred example of the fabric is a composite fabric of the poly(trimethylene terephthalate) fiber with a stretch fiber represented by a polyurethane elastic fiber.

The fabric of the present invention, including the above-described composite fiber, is not particularly limited on the shape and the weaving and knitting method and can be produced by a known method. Examples thereof include plain weave woven fabrics using the polyester fiber of the present invention for warp yarn and weft yarn, woven fabrics such as reversible woven fabric, and knitted fabrics such as tricot and raschel fabric. In addition, doubling, composite twisting or interlacing may also be applied.

The stretch fiber for use in the present invention is not particularly limited but examples thereof include a dry spun or melt spun polyurethane elastic fiber and a polyester-based elastic fiber represented by poly(butylene terephthalate) fiber and poly(tetramethylene glycol) copolymerized poly (butylene terephthalate) fiber. In the blend fabric using a stretch fiber, the content of the polyester fiber of the present invention is not particularly limited but it is preferably from 60 to 98%.

The fabric of the present invention, including a composite fabric, can be dyed, for example, after the weave-knitting, by a conventional process through scouring, pre-setting, dyeing and final setting. If desired, a caustic reduction treatment may also be applied after the scouring but before the dyeing.

The scouring may be performed at a temperature of from 40 to 98° C. Particularly, in the case of a blend fabric with a stretch fiber, the fabric is preferably scoured while relaxing it so as to improve the elasticity.

One or both of the heat setting after the dyeing and the heatsetting before the dyeing may be omitted, however, both are preferably performed so as to improve the shape stability and dyeability of fabric. The heatsetting temperature is from 120 to 190°C., preferably from 140 to 180° C., and the heatsetting time is from 10 seconds to 5 minutes, preferably from 20 seconds to 3 minutes.

The dyeing may be performed without using a carrier at a temperature of from 70 to 150° C., preferably from 90 to 120° C., more preferably from 90 to 100° C. For attaining uniform dyeing, it is preferred to use acetic acid or sodium hydroxide to control the pH according to the dye and at the same time to use a dispersing agent comprising a surfactant. In the case of using a cationic dye, an alkali metal or alkaline earth metal salt such as sodium sulfate, sodium nitrate, potassium sulfate and calcium sulfate, is particularly preferably added to the dye bath so as to improve the brilliance of a dyed product.

After the dyeing, the fabric may be subjected to soaping or reduction cleaning by a known method. In the combination with a stretch fiber, particularly, in the case where a fiber composite fabric comprising an atmospheric disperse dye-dyeable fiber and a polyurethane elastic fiber is dyed, it is important for improving the color fastness of fabric to completely remove the disperse dye staining the polyurethane elastic fiber. For removing the disperse dye, a known method may be used. For example, the treatment may be performed in an alkali aqueous solution such as sodium carbonate and sodium hydroxide using a reducing agent such as sodium hydrosulfite.

Noticeable examples of the use form of the poly (trimethylene terephthalate)-base fiber of the present invention, which can be dyed into heavy shade by either one or both of a cationic dye and a disperse dye under atmospheric pressure, are described below.

(1) In the combination with a fiber having low thermal resistance, such as a stretch fiber represented by polyurethane elastic fiber, wool, silk or an acetate fiber, the poly (trimethylene terephthalate)-based fiber. of the present invention can be dyed into a dark shade under atmospheric pressure without impairing the capability of the fiber having low thermal resistance. In particular, when the poly (trimethylene terephthalate)-base fiber is blended with a polyurethane elastic fiber, a clothing of new feeling favored with softness and touch different from the blend fabric using a nylon fiber and also with an easy-care property can be created.

(2) A composite fabric of an ordinary poly(trimethylene terephthalate) fiber,and a polyurethane elastic fiber is necessary to be dyed at from 110 to 120° C., therefore, the polyurethane elastic fiber thermally deteriorates. In addition, the fabric can be dyed only with a disperse dye. If the blend fabric with a polyurethane elastic fiber is dyed with a disperse dye, the disperse dye is exhausted in a greater amount to the polyurethane elastic fiber than to the poly (trimethylene terephthalate) fiber and, moreover, the dye is not firmly fixed to the polyurethane elastic fiber. For example, the fiber dispersion dye readily transfers to the clothing in the periphery to stain it during dry cleaning or laundering or, in some cases, the dye is eliminated, as a result, the color of the composite fabric fades and the color fastness decreases. These problems can be overcome by using the poly(trimethylene terephthalate)-based fiber of the present invention, which can be dyed into dark shade with either one or both of a cationic dye and a disperse dye under atmospheric pressure.

More specifically, the first method is the use of poly (trimethylene terephthalate) fiber of the present invention which is cationic dye dyeable under atmospheric pressure.

The polyurethane elastic fiber is not cationic dye dyeable but when the poly(trimethylene terephthalate)-based fiber which is cationic dye dyeable under atmospheric pressure is used, only the poly(trimethylene terephthalate)-based fiber is selectively dyed, therefore, the above-described problem of staining does not arise.

The second method is the use of the poly(trimethylene terephthalate) fiber which is dyeable with a disperse dye under atmospheric pressure of the present invention. The poly(trimethylene terephthalate)-based fiber is modified to have disperse-dye dyeability under atmospheric pressure and by this, the transfer of disperse dye to the polyurethane elastic fiber can be fairly prevented.

(3) One of the promising fields of use of the blending with a stretch fiber represented by a polyurethane elastic fiber is the field of panty stockings. In this industry, the exclusive dyeing factory usually does not have a high pressure dyeing furnace necessary for high-pressure dyeing. Use of the poly(trimethylene terephthalate) fiber dyeable with cationic dye or disperse dye under atmospheric pressure of the present invention is advantageous in view of facilities because the atmospheric dyeing vessel heretofore used for nylon fiber union knitted panty stocking can be used as it is without investing in new equipment. This advantage in facilities is, industrially, a very important effect.

(4) The fabric obtained using the poly(trimethylene terephthalate)-based fiber of the present invention is by far softer, for example, than the known blend fabric of a nylon fabric and a polyurethane elastic fiber, is free of waxy feeling peculiar to the nylon fiber, is favored with light stretchability and excellent coloring property, and thus provides clothing of new feeling. Furthermore, the poly (trimethylene terephthalate)-base fiber has excellent heat settability and excellent color fastness. These features reveal the absence of problems peculiar to the nylon fiber and the clothing provided is mild in the handling.

(5) The polyester fiber of the present invention exhibits excellent effect also in the combining with a cellulose fiber. In the case where a reactive dye is used for the dyeing of a cellulose fiber, the reactive dye decomposes in many cases at a dye bath temperature in excess of 100° C. By using the poly(trimethylene terephthalate)-based fiber of the present invention, one bath one step dyeing can be performed using a cationic dye or a disperse dye and a reactive dye under atmospheric pressure. The fabric thus obtained can give clothing of new feeling having both the dry feeling peculiar to cellulose and the softness originated from poly (trimethylene terephthalate).

(6) The polyester fiber of the present invention can also be applied by itself to woven or knitted fabrics. The fabric obtained can be abundant in softness and exhibits excellent stretchability and coloring properties. If no problem arises in the dyeing at 100° C. or more, the fabric may be dyed even at 100° C. or more.

Furthermore, the polyester fiber of the present invention is characterized in that despite a cationic dye dyeable fabric, the amount and rate of caustic reduction can be industrially controlled. The polyester fiber of the present invention after the caustic reduction can be more intensified in the softness and additionally, due to the presence of microscopic pores on the order of a few $\mu$m on the fiber surface, also can have characteristic features such as dry feeling and brilliant color. The atmospheric disperse dye-dyeable polyester fiber of the present invention also exhibits similar caustic reduction properties.

As such, the poly(trimethylene terephthalate)-base fiber of the present invention can be used according to the above-described use forms for clothing such as outer clothing, inner wears, lining and sportswear, and additionally for materials such as carpet feed yarn, padding cloth and flocky cloth.

BEST MODE FOR CARRYING OUT THE INVENTION

The present invention is described in greater detail below by referring to the Examples, however, the present invention should not be construed as being limited to these Examples. In the Examples, the main measurement values and evaluation values were obtained by the following measuring methods and evaluation methods.

(1) Measurement of Intrinsic Viscosity

The intrinsic viscosity [η] was measured at 35° C. with o-chlorophenol using an Ostwald's viscometer.

(2) Measurement of Loss Tangent

A loss tangent (tan δ) and a dynamic viscoelasticity at each temperature were measured in a dry air at a measurement frequency of 110 Hz and a temperature-rising rate of 5° C./min using LEOVIBRON manufactured by Orienteck K.K. From the values obtained, a loss tangent-temperature curve was configured and Tmax (° C.) as a peak temperature of the loss tangent was determined on the curve.

(3) Measurement of Elastic Modulus

The modulus was measured according to JIS-L-1013.

(4) Measurement of Melting Point

The melting point was measured at a temperature-rising rate of 20° C./min in a nitrogen stream flowing at 100 ml/min using DSC manufactured by Seiko Electric Corporation. A peak value at the peak of melting was used as the melting point.

(5) Measurement of Elastic Recovery

A fiber was fixed to a tensile tester with a chuck-to-chuck distance of 20 cm, elongated at a pulling rate of 20 cm/min to an elongation of 20%, then allowed to stand for 1 minute, and thereafter shrunk at the same rate. In this way, a stress-strain curve was configured. The elongation when the stress became 0 during the shrinking was defined as a residual elongation (X). The elastic recovery was obtained according to the following formula:

$$\text{Elastic Recovery} = \frac{20 - X}{20} \times 100\,(\%)$$

(6) Measurement of b Value

The degree of yellow tinting of the fiber obtained was measured using a "b" value. The b value was measured using a color computer manufactured by Suga Shikenki K.K. The larger the b value is, the higher the degree of yellow tinting.

(7) Evaluation Test of Dyeability

1) Evaluation of Dyeability of Polyester Fiber with Cationic Dye

A single end fed knitted fabric (circular knitting, plain stitch fabric, gauge: 28) of polyester fiber was used as a sample. The sample was scoured at 70° C. for 20 minutes in hot water containing 2 g/l of Scourol 400 (a nonionic surfactant, produced by Kao Corporation) (bath ratio: 1:50), dried by a tumbler dryer, heat set at 1 80° C. for 30 seconds using a pin tenter and then tested. The dye used was KAYACRYL BLUE GSL-ED (a cationic dye, produced by Nippon Kayaku K.K.) and the dyeing was performed using 4.0% owf of the dye at a bath ratio of 1:50 and 95° C. for 30 minutes. As additives, 0.25 g/l of acetic acid and 3 g/l of sodium sulfate were added to control the pH.

2) Evaluation of Dyeability of Polyester Fiber with Disperse Dye

A single end fed knitted fabric (circular knitting, plain stitch, gauge: 28) of polyester fiber was used as a sample. The sample was scoured at 70° C. for 20 minutes in hot water containing 2 g/l of Scourol 400 (bath ratio: 1:50), dried by a tumbler dryer, heat set at 180° C. for 30 seconds using a pin tenter and then tested. The dye used was Kayaron Polyester Blue 3RSF (a disperse dye, produced by Nippon Kayaku Co., Ltd.) and the dyeing was performed using 6% owf of the dye at a bath ratio of 1:50 and 95° C. for 60 minutes. As a dispersing agent, 0.5 g/l of Niccasunsolt 7000 (an anionic surfactant, produced by Nikka Chemicals Co., Ltd.) was used, and the pH was adjusted to 5 by adding 0.25 ml/l of acetic acid and 1 g/l of sodium acetate.

The dye exhaustion was obtained by determining an absorbency A of the dye stock solution and an absorbency a of the initial dye bath solution after the dyeing using a spectrophotometer and substituting the absorbency values to the following formula. The absorbency used was a value at 580 nm which is the maximum absorption wavelength of the dye.

$$\text{Dye Exhaustion}=(A-a)/A\times 100(\%)$$

The color depth for showing the degree of dark shade attained by the dyeing was evaluated using K/S. The K/S value was determined by measuring a spectral reflectance R of the dyed sample cloth and substituting R to the Kubelka-Munk formula shown below. The R value used is a value at the maximum absorption wavelength of the dye.

$$K/S=(1-R)^2/2R$$

When the sample was dyed black, the brightness was evaluated using the L value.

(8) Color Fastness Test

The color fastness test of dyed fiber performed using the single end fed stitch knitted fabric dyed by the method in (6) and then evaluated.

The color fastness to dry cleaning was evaluated according to JIS-L-0860, the color fastness to light was according to JIS-L-0842, the color fastness to laundering was according to JIS-J-0844, and the color fastness to rubbing in dry or wet state was according to JIS-L-0849. For evaluating the color fastness to dry cleaning, liquid staining was tested.

(9) Measurement of U %

The U % was measured using Uster Tester 3. manufactured by Zerveger Uster K.K.

EXAMPLE 1

Using 1,144 parts by weight of trimethylene glycol (hereinafter simply referred to as "TMG"), 1,300 parts by weight of dimethyl terephthalate. (hereinafter simply referred to as "DMT"), 57 parts by weight (2 mol % based on the total molar number of all acid components) of tetrabutylphosphonium 5-sulfoisophthalate (hereinafter simply referred to as "SIPP"), 0.43 parts by weight of lithium acetate as the ether formation inhibitor, 0.13 parts by weight of cobalt acetate as the discoloration inhibitor, and 1.3 parts by weight of titanium tetrabutoxide as the ester interchange catalyst, an ester interchange reaction was performed at 220° C. Subsequently, 1.3 parts by weight of titanium tetrabutoxide as the polycondensation catalyst, and 0.065 parts by weight of trimethyl phosphite as the thermal stabilizer were added and polycondensed at 270° C. under reduced pressure of 0.5 torr to obtain a polymer. The polymer obtained had an intrinsic viscosity of 0.61.

The polymer chip obtained was dried and then spun at a spinning temperature of 265° C. and a spinning rate of 1,200 m/min using a spinneret having 36 orifices (diameter: 0.23 mm) each having a round cross section to prepare undrawn yarns. The undrawn yarns obtained were draw-twisted using a hot roll at 50° C. and a hot plate at 140° C. at a draw ratio of 3.0 times and a drawing rate of 600 m/min to obtain drawn yarns of 50 d/36 f. The fiber had physical properties such that the melting point was 231° C., the density was 1.32 g/cm$^3$, the tenacity was 3.4 g/d, the elongation was 37%, Tmax was 110° C., U % was 1.2%, the modulus was 22 g/d, and the elastic recovery was 87%. The Q/R value of drawn yarn was 0.25 and satisfied formula (1). The b value of fiber was 6.1.

The polyester fiber obtained in this Example had a cationic dye exhaustion as large as 72% at 95° C. for 30 minutes, and a very brilliant dyed product could be obtained.

After the dyeing, a single end fed knitted fabric was produced and examined on the color fastness to dry cleaning solvent. Then, the dyed product did not fade and the solution staining was class 4 to 5. Also, good results were obtained with respect to the color fastness to light (class 4 to 5), the color fastness to abrasion in dry or wet state (class 5) and the color fastness to laundry (class 5).

EXAMPLES 2 TO 7

Polymerization and spinning were performed in the same manner as in Example 1 by varying the kind of ester-forming sulfonate compound and the copolymerizing ratio. The test and evaluation results of fibers obtained are shown in Table 1. In any Example, the fiber satisfied formula (1) and exhibited excellent dyeability, high color fastness and good physical properties.

COMPARATIVE EXAMPLE 1

A poly(trimethylene terephthalate) homopolymer was obtained in the same manner as in Example 1 except that SIPP was not used. The polymer obtained had an intrinsic viscosity of 0.63. This polymer chip was spun and drawn in the same manner as in Example 1 to obtain a fiber. The fiber obtained had a melting point of 236° C., Tmax of 111° C., a tenacity of 3.6 g/d, an elongation of 35%, a modulus of 23 g/d and a modulus recovery of 88%. The Q/R value of this fiber was 0.26 and satisfied formula (1).

However, the polyester fiber obtained in this Comparative Example had a cationic dye exhaustion of 6%. at 95° C. for 30 minutes, thus, could not be dyed into dark shade.

COMPARATIVE EXAMPLE 2

A polymer was prepared in the same manner as in Example 1 except that the copolymerizing ratio of SIPP was 0.3 mol %. The test and evaluation results of fiber obtained are shown together in Table 1. The copolymerizing ratio of ester-forming sulfonate compound was less than 0.5 mol % and the fiber had a cationic dye exhaustion of 30% at 95° C. for 30 minutes, thus, could not be dyed into dark shade.

COMPARATIVE EXAMPLE 3

A fiber was prepared through polymerization and spinning in the same manner as in Example 1 except that the copolymerizing ratio of SIPP was 6 mol %. The test and evaluation results thereof are shown together in Table 1. At the spinning of this polymer, yarn breaking was generated frequently, revealing bad spinnability. Furthermore, when the fiber was dyed at 95%, the yarn was shrunk and turned hard, as a result, a fabric having good touch could not be obtained. Also, the fabric obtained was reduced in the color fastness to dry cleaning solvent as compared with the fabric of Example 1.

COMPARATIVE EXAMPLE 4

In Example 1, the draw ratio was changed to 3.3 times. The fiber obtained was excessively oriented and had Tmax in excess of 115° C. The cationic dye exhaustion was 45%. Furthermore, in the fiber obtained, many broken filaments were generated.

was 70° C. A fiber could be obtained without problems such as yarn breaking and generation of broken filaments. However, the fiber obtained had an elastic recovery as low as 55% and the Q/R value was 0.49 and could not satisfy formula (1).

COMPARATIVE EXAMPLE 7

Polymerization and spinning were performed in the same manner as in Example 1 except that the hot plate temperature was 200° C. The fiber was:broken on the hot plate and could not be drawn.

COMPARATIVE EXAMPLE 8

Polymerization and spinning were performed in the same manner as in Example 1 except that the draw ratio was 2.3 times and the hot plate temperature was 180° C. A fiber could be obtained without problems such as yarn breaking and generation of broken filaments. However, the fiber obtained had an elastic recovery as low as 48% and the Q/R value was 0.52 and could not satisfy formula (1).

COMPARATIVE EXAMPLE 9

Spinning was performed using a poly(ethylene terephthalate) fiber obtained by copolymerizing 2.5 mol % of 5-sodium sulfoisophthalate. The fiber obtained exhibited a tenacity of 4.2 g/d, an elongation of 30%, a modulus of 100 g/d, an elastic recovery of 31%, a Q/R value of 3.2 and Tmax of 131° C. The cation dye exhaustion at 95° C. for 30 minutes was 36%.

TABLE 1

| | Copolymerizing component | | Melting point | Intrinsic viscosity | Tenacity | Elongation | Modulus | Elastic recovery | | Tmax | U % | Dye exhaustion | CD Fastness | b |
|---|---|---|---|---|---|---|---|---|---|---|---|---|---|---|
| | kind | mol % | (° C.) | [η] | (g/d) | (%) | (g/d) | (%) | Q/R | ° C. | % | (%) | (class) | Value |
| Example 1 | SIPP | 2 | 231 | 0.61 | 3.4 | 37 | 22 | 87 | 0.25 | 110 | 1.2 | 72 | 4–5 | 6.1 |
| Example 2 | SIPM | 2 | 232 | 0.48 | 3.4 | 34 | 24 | 76 | 0.32 | 110 | 0.9 | 94 | 4–5 | 6.2 |
| Example 3 | SIPA | 2 | 219 | 0.50 | 2.0 | 30 | 20 | 70 | 0.29 | 110 | 1.1 | 78 | 4–5 | 6.3 |
| Example 4 | SIPP | 1 | 234 | 0.63 | 3.3 | 40 | 22 | 88 | 0.25 | 112 | 1.2 | 70 | 4–5 | 6.5 |
| Example 5 | SIPP | 5 | 228 | 0.59 | 3.4 | 39 | 23 | 88 | 0.26 | 107 | 1.4 | 83 | 4–5 | 6.7 |
| Example 6 | SIPM | 1.5 | 232 | 0.60 | 3.0 | 32 | 22 | 88 | 0.25 | 109 | 1.2 | 94 | 5 | 6.7 |
| Example 7 | SIPM | 3.0 | 230 | 0.57 | 2.7 | 33 | 23 | 85 | 0.26 | 108 | 1.0 | 95 | 4–5 | 6.5 |
| Comparative Example 1 | — | 0 | 236 | 0.63 | 3.6 | 35 | 23 | 88 | 0.26 | 111 | — | 6 | — | 6.2 |
| Comparative Example 2 | SIPP | 0.3 | 234 | 0.62 | 3.5 | 35 | 24 | 88 | 0.27 | 111 | — | 30 | — | 6.3 |
| Comparative Example 3 | SIPP | 6 | 225 | 0.59 | 3.3 | 38 | 21 | 63 | 0.33 | 106 | — | 98 | 3–4 | 6.4 |
| Comparative Example 4 | SIPP | 2 | 231 | 0.61 | 4.1 | 20 | 25 | 95 | 0.26 | 116 | 3.1 | 45 | 4–5 | 6.2 |

SIPM: dimethyl 5-sodium sulfoisophthalate
SIPA: dimethyl ammonium 5-sulfoisophthalate
DC fastness: color fastness to dry cleaning solvent

COMPARATIVE EXAMPLE 5

Polymerization and spinning were performed in the same manner as in Example 1 except that the hot roll temperature was 25° C. At the drawing, yarn breaking was generated frequently and a fiber could not be continuously obtained. Also, polymerization and spinning were performed in the same manner as in Example i except that the hot roll temperature was 80° C. The yarn melted to adhere the hot roll at the drawing and single filament breaking was generated frequently. Furthermore, the fiber obtained was full of broken filaments and U % was bad and as high as 3.2.

COMPARATIVE EXAMPLE 6

Polymerization and spinning were performed in the same manner as in Example 1 except that the hot plate temperature

REFERENCE EXAMPLE 1

The experiment of Example 1 was repeated except that cobalt acetate and trimethyl phosphite were not used. In this case, the physical properties of fiber were not changed, but the fiber had a b value of 11.2, thus, turned yellow.

EXAMPLE 8

The polymer obtained in Example 2 was dried to have a water content of 50 ppm, melted at 285° C. and then extruded through a spinneret having 36 orifices having a diameter of 0.23 mm and arrayed in a single line. The extruded molten multifilament was passed through a heat insulating region in a length of 5 cm and at a temperature of 100° C., then rapidly cooled by applying thereto wind at a wind velocity of 0.4 m/min, and thereby converted into solid multifilament. This solid multifilament was thermally drawn and heatset by passing it through a first roll heated at 60° C. and rotating at a rotation speed of 2,100 m/min and a second roll heated at 133° C. and rotating at a rotation speed of 4,300 m/min, and then taken up. The fiber obtained was formed into two ply yarns of 75 d/72 f.

The fiber obtained exhibited a tenacity of 3.1 g/d, an elongation of 41%, U % of 0.7%, a modulus of 22 g/d, an elastic recovery of 89%, Q/R of 0.25, Tmax of 109° C., a cationic dye exhaustion at 95° C. for 30 minutes of 98%, and a b value of 6.5.

EXAMPLE 9

A warp knitted fabric was knitted using the polyester fiber of. Example 1 and Loica of 210 denier (polyurethane-base stretch fiber, produced by Asahi Chemical Industry Co., Ltd.). The knitting gauge was 28 G, the loop length was 1,080 mm/480 course for polyester fiber and 112 mm/480 course for stretch fiber, and the driving density was 90 course/inch. The ratio of polyester fiber mixed was set to 75.5%.

The green fabric obtained was subjected to relax scouring at 90° C. for 2 minutes and then to dry heatsetting at 160° C. for 1 minute. Separately, a dye solution was prepared using Kayacryl Black BS-ED (cationic dye, produced by Nippon Kayaku Co., Ltd.) and as a dispersing agent, 1 g/l of Disper, TL (nonionic surfactant, produced by Meisei Chemical Works Ltd.) by adding the dye to an aqueous solution having added thereto 50 g/l of sodium sulfate and 15 g/l of sodium carbonate and adjusted to a pH or 11. The fabric obtained above was dyed using this dye solution at a dyeing concentration of 8% owf, a liquor to goods ratio of 1:50 and a temperature of 95° C. for 1 hour. After the dyeing, the fabric was soaped with 1 g/l of Gran Up P (nonionic surfactant, produced by Sanyo Kasei Chemical Industries Ltd.) at a liquor to goods ratio of 1:50 and a temperature of 80° C. for 10 minutes. The thus-dyed fabric was finished according to a conventional process. The dyed product had an L value of 11.2, revealing satisfactory dyeing. Furthermore, the dyed product had dyed color fastness such that the color fastness to laundry was class 5, the color fastness to rubbing in wet state was class 5 and the color fastness to light was class 4 to 5. The knitted fabric after the dyeing exhibited soft, highly stretching and excellent touch with tensiness and resiliency.

EXAMPLE 10

The same operation as in Example 9 was repeated using the polyester fiber of Example 2. The dyed product obtained had an L value of 10.9, revealing satisfactory dyeing. This dyed product had dyed color fastness such that the color fastness to laundry was class 5, the color fastness to abrasion in wet state was class 5 and the color fastness to light was class 4 to 5. Furthermore, the dyed product exhibited soft, highly stretchy and excellent touch with tensiness and resiliency.

COMPARATIVE EXAMPLE 10

The same knitted fabric as in Example 9 was knitted using the poly(trimethylene terephthalate) fiber prepared in Comparative Example 1.

The gray fabric obtained was subjected to relax scouring at 90° C. for 2 minutes and then dry heat setting at 160° C. for 1 minute. For dyeing into dark shade, the fabric was dyed at 95° C. for 60 minutes at a pH of 6 adjusted by acetic acid and at a liquor to goods ratio of 1:30 using 8% owf of Dianics Black BG-FS (disperse dye, produced by Dystar Japan) in the presence of 0.5 g/l of Niccasunsolt 1200 as a dyeing aid. The dyed product obtained had color fastness to rubbing in wet state of class 2. The stretch fiber was stained and this reveals liberation of the disperse dye.

Also, the same operation as in Example 9 was repeated using the fiber prepared in Comparative Example 9. The fabric obtained was apparently rigid and had an L value of 21, thus, only dyeing into shallow shade could be attained. For the purpose of comparison, a warp knitted fabric was prepared using nylon 6 fiber spun by a conventional process and Loica in the same manner as in Example 9 and dyed using 7% owf of Kayaron Black BGL (acid dye, produced by Nippon Kayaku Co., Ltd.) at 100° C. for 60 minutes. The dyed fabric obtained had color fastness to light of class 2 to 3.

EXAMPLE 11

A plain weave woven fabric (warp: 140 yarns/25.4 mm, weft: 80 yarns/25.4 mm) was prepared using a polyester fiber of 75 d/36 f obtained in the same manner as in Example 1 for warp yarns and cuprammonium rayon of 75 d/44 f for weft yarns. This plain weave woven fabric was scoured by a conventional process, washed with water, preset at 180° C. for 30 seconds, and then subjected to one bath one step dyeing with a cationic dye and a reactive dye without using a carrier. The cationic dye used was Kayacryl Black BS-ED (produced by Nippon Kayaku Co. Ltd.) and the reactive dye used was Drimarene Blue X-SGN (produced by Sandoz A. G.). The dyeing solution was prepared by adding the dyes to an aqueous solution having added thereto 50 g/l of sodium sulfate and 15 g/l of sodium carbonate and adjusted to a pH of 11, using 1 g/l of Disper TL (produced by Meisei Chemical works Ltd.) as a dispersing agent. The dyeing was performed at a concentration of 2% owf, a liquor to goods ratio of 1:50 and 100° C. for 1 hour. After the dyeing, the fabric was soaped using 1 g/l of Gran Up P (produced by Sanyo Chemical Industries Ltd.) at a liquor to goods ratio of 1:50 and 80° C. for 10 minutes. The dyed fabric was finished by a conventional process. The dyed product obtained was a uniformly dyed and brilliant dyed product. K/S was 24.3. Despite omission of caustic reduction treatment commonly performed for polyester fibers, the touch was excellent having soft touch and dry feeling, which could not be attained by conventional woven fabrics. The color fastness to dry cleaning solvent was class 5, the color fastness to rubbing in wet state was class 5, and the color fastness to light was class 4.

Also, a plain weave woven fabric was manufactured using a polyester fiber of 75 d/36 f obtained in the same manner as in Example 1 for both the weft and warp yarns, and then dyed. The fabric obtained had no dry feeling but was extremely soft and exhibited stretchability of about 7% in the weft direction.

EXAMPLE 12

A single end fed knitted fabric (circular knitting, plain stitch, gauge: 28) was prepared from the fiber obtained in Example 1, a poly(ethylene terephthalate) film obtained through polymerization and spun in the same manner as in Example 1, or a poly(ethylene terephthalate) fiber obtained by the copolymerization of 3 mol % of s-sodium sulfoisophthalate and subjected to a caustic reduction treatment test.

Here, after the knitting, the single end fed knitted fabrics (circular knitted, plain. stitch; G28) were each scoured at 70° C. for 20 minutes using warm water containing 2 g/l of SCOURROLL 400, dried by a tumbler dryer and then heatset at 180° C. for 30 seconds using a pin tenter and then used. The caustic reduction treatment was performed by immersing each single end fed knitted fabric in a 6 wt % aqueous solution of sodium hydroxide under boiling for 20 minutes. The caustic reduction ratio was evaluated by the value obtained by dividing the decremental weight of knitted fabric due to the caustic reduction treatment by the original weight of knitted fabric.

As a result, the reduction ratio of single end fed knitted fabric of the fiber obtained in Example 1 and that of single end fed knitted fabric of the poly(ethylene terephthalate) fiber were 25.4 wt % and 10.3 wt %, respectively. As such, the polyester fiber of the present invention exhibits a caustic reduction rate close to that of poly(ethylene terephthalate) fiber.

COMPARATIVE EXAMPLE 11

A polyethylene terephthalate) fiber obtained by copolymerizing 3 mol % of s-sodium sulfoisophthalate knitted in the same manner as in Example 12 to prepare a single stitch knitted fabric. This single stitch knitted fabric was subjected to a caustic reduction treatment in the same manner as in Example 12, then the knitted fabric was completely decomposed, dissolved and lost. Thus, the poly(ethylene terephthalate) fiber obtained by copolymerizing 3 mol % of s-sodium sulfoisophthalate could not be substantially subjected to a caustic reduction treatment due to its excessively high reduction rate.

EXAMPLE 13

A fiber was prepared by copolymerizing 2 mol % of dimethyl s-sodium sulfoisophthalate and 5 wt % of dimethyl adipate in the same manner as in Example 1. The fiber had physical properties such that the melting point was 220° C., the tenacity was 3.6 g/d, the elongation was 34%, the modulus was 22 g/d, the elastic recovery was 90% and the Q/R value was 0.24.

The polyester fiber obtained in this Example had a cationic dye exhaustion of 95% at 95° C. for 30 minutes and a disperse dye exhaustion of 95% at 95° C. for 60 minutes. Thus, this fiber exhibited high dyeability under atmospheric pressure for both the cationic dye and the disperse dye.

With respect to the color fastness against dry cleaning solvent of the single end fed knitted fabric after the dyeing, the dyed product did not fade. The solution staining was class 4 to 5 with both the cationic dye and the disperse dye. Also, good results were obtained about the color fastness to light (class 4 to 5), the color fastness to rubbing in dry or wet state (class 5) and the color fastness to laundry (class 5).

Furthermore, woven fabrics were prepared in the same manner as in Examples 9 and 11, then the fabrics obtained had the same excellent touch as in Examples 9 and 11.

EXAMPLE 14

The fiber obtained in Example 2 was cut to obtain staples each having a fiber length of 39 mm. Using a filament of 20 d/2 f obtained in the same manner as in Example 2, a composite yarn having a filament mixed ratio of 11 wt % was obtained, where the staples were arrayed in the sheath. This composite yarn was woven into a woven fabric consisting of warp yarns (weaving density: 146 yarns/25.4 mm) and weft yarns (weaving density: 77 yarns/25.4 mm). The woven fabric obtained was dyed at 95° C. according to the method described in Example 9.

The dyed fabric had K/S of 25.3, revealing dyeing into dark shade. Furthermore, the fabric obtained had excellent properties with respect to tensiness, resiliency, and repulsion.

EXAMPLE 15

The polymer obtained in Example 2 was subjected to solid state polymerization at 200° C. for 24 hours in nitrogen to obtain a polymer having an intrinsic viscosity of 1.0. this polymer was spun in the same manner as in Example 1. The fiber obtained had physical properties such that the tenacity was 4.0 g/d, the elongation was 32%, U % was 1.0%, the modulus was 23 g/d, the elastic recovery was 91%, the Q/R value was 0.25, Tmax was 110° C. and the b value was 4.3.

EXAMPLE 16

Using 1,031 parts by weight of TMG, 106 parts by weight of 1,4-butanediol (hereinafter simply referred to as "4G"), 1,300 parts by weight of DMT and 1.3 parts by weight of titanium tetrabutoxide, an ester interchange reaction was performed at 220° C. Subsequently, 0.01 part by weight of trimethyl phosphate was added and polycondensed at 250° C. under reduced pressure of 0.5 torr to obtain a polymer. The polymer obtained had an intrinsic viscosity of 0.8. The 4G component in the polymer was measured by NMR and found to be 4.1 wt %.

The polymer chip obtained was dried and then spun at a spinning temperature of 265° C. and a spinning rate of 1,200 m/min using a spinneret having 36 orifices (diameter: 0.23 mm) each having a round cross section to prepare undrawn yarns. The undrawn yarns obtained were draw-twisted using a hot roll at 60° C. and a hot plate at 140° C. at a draw ratio of 2.9 times and a drawing rate of 600 m/min to obtain drawn yarns of 50 d/36 f. The fiber had physical properties such that the melting point was 224° C., Tmax was 98° C., the tenacity was 3.6 g/d, the elongation was 40%, U % was 1.2%, the modulus was 23 g/d, the elastic recovery was 83% and the value was 4.5. The Q/R value of this fiber was 0.28 and satisfied formula (1).

The polyester fiber obtained in this Example had a disperse dye exhaustion as high as 78% at 95° C. for 60 minutes.

After the dyeing, a single stitch knitted fabric was produced and examined on the color fastness to dry cleaning solvent. Then, the dyed product did not fade and the solution staining was class 3.5. Also, good results were obtained with respect to the color fastness to light (class 4 to 5), the color fastness to rubbing in dry or wet state (class 5) and the color fastness to laundry (class 5).

EXAMPLES 17 TO 21

Polymerization and spinning were performed in the same manner as in Example 16 by varying the kind of glycols and the ratio of a glycol to TMG. The test and evaluation results of fibers obtained are shown together in Table 2. In any case, the fiber satisfied formula (1) and exhibited excellent dyeability, high color fastness and good physical properties.

COMPARATIVE EXAMPLE 12

Using the polymer of Comparative Example 1, a fiber was prepared according to Example 1. The polyester fiber obtained was subjected to 2) Evaluation of Dyeability of Polyester Fiber with Disperse Dye of (7) Evaluation Test of Dyeability. The polyester fiber obtained in this Example had Tmax in excess of 102° C. This fiber had a disperse dye exhaustion of 36% at 95° C. for 60 minutes, thus, could not be dyed into dark shade. However, when the dyeing was performed at a dyeing concentration of 0.5% owf, the dye exhaustion was improved to 81%. From this result, it is seen that the poly(trimethylene terephthalate) fiber exhibits dyeability under atmospheric pressure at a low dye concentration, however, when the dye concentration is increased, the fiber does not exhibit dyeability under atmospheric pressure.

COMPARATIVE EXAMPLE 13

Polymerization and spinning were performed in the same manner as in Example 16 except that the ratio of TMG to 4G was changed. The results obtained are shown in Table 2. The ratio of 4G component was less than 1.5 wt % and Tmax of the fiber was 106° C. The disperse dye exhaustion at 95° C. for 60 minutes was low and the fiber could not be dyed into dark shade.

70% was obtained but the color fastness to dry cleaning solvent was very poor and class 1. Furthermore, the melting point of fiber was as low as 210° C. and when false twist or the like was tried, the yarn was melted and adhered to the heater and could not be processed.

COMPARATIVE EXAMPLE 16

Polymerization and spinning were performed in the same manner as in Example 16 except that cyclohexane dimethanol (hereinafter simply referred to as "C6-2G") was used in place of 4G and the ratio of TMG to C6-2G was changed. The results obtained are shown in Table 2. The 30 ratio of C6-2G was 12.6 wt %. This yarn had a modulus of 24 g/d, an elastic recovery of 34% and a Q/R value of 0.71, thus failing in satisfying formula (1). The fabric obtained from this yarn was deficient in the elastic recovery. Furthermore, the fiber had Tmax of 62° C. and the fabric dyed at 95° C. for 60 minutes shrank and turned rigid.

COMPARATIVE EXAMPLE 17

Polymerization and spinning were performed in the same manner as in Example 16 except that ethylene glycol

TABLE 2

| | Copolymerizing component | | Melting point | Intrinsic viscosity | Tenacity | Elongation | Modulus | Elastic recovery | | Tmax | U % | Dye exhaustion | CD Fastness | b |
|---|---|---|---|---|---|---|---|---|---|---|---|---|---|---|
| | kind | wt % | (° C.) | [η] | (g/d) | (%) | (g/d) | (%) | Q/R | ° C. | % | (%) | (class) | Value |
| Example 16 | 4G | 4.1 | 224 | 0.63 | 3.6 | 40 | 23 | 83 | 0.28 | 98 | 1.2 | 78 | 4 | 4.5 |
| Example 17 | 4G | 5.2 | 220 | 0.60 | 3.5 | 46 | 23 | 81 | 0.28 | 96 | 1.0 | 82 | 3 | 4.3 |
| Example 18 | 4G | 9.3 | 213 | 0.57 | 3.4 | 41 | 24 | 80 | 0.30 | 85 | 1.5 | 95 | 3 | 4.6 |
| Example 19 | 3G-2 | 4.8 | 218 | 0.57 | 3.5 | 38 | 26 | 82 | 0.32 | 100 | 1.2 | 70 | 3 | 5.4 |
| Example 20 | 6G | 3.0 | 220 | 0.61 | 3.3 | 41 | 24 | 80 | 0.30 | 95 | 0.8 | 71 | 3 | 5.8 |
| Example 21 | C6-2G | 4.7 | 223 | 0.56 | 3.5 | 42 | 25 | 82 | 0.30 | 92 | 1.2 | 88 | 3 | 5.3 |
| Comparative Example 12 | — | 0 | 236 | 0.63 | 3.6 | 35 | 23 | 85 | 0.26 | 111 | — | 36 | — | 5.2 |
| Comparative Example 13 | 4G | 0.8 | 229 | 0.60 | 3.9 | 38 | 24 | 86 | 0.26 | 106 | — | 47 | — | 5.6 |
| Comparative Example 14 | 4G | 10.3 | 202 | 0.58 | 3.4 | 41 | 24 | 72 | 0.33 | 68 | — | 99 | 1 | 5.3 |
| Comparative Example 15 | 6G | 8.7 | 210 | 0.55 | 3.2 | 46 | 24 | 77 | 0.31 | 74 | — | 99 | 1 | 5.1 |
| Comparative Example 16 | C6-2G | 12.6 | 202 | 0.60 | 2.6 | 43 | 24 | 34 | 0.71 | 62 | — | — | — | 5.0 |
| Comparative Example 17 | 2G | 5.0 | 215 | 0.53 | 3.4 | 4 | 23 | 70 | 0.29 | 100 | — | 70 | 1 | 18.3 |

4G: 1,4-butanediol
6G: 1,6-hexanediol
3G-2: neopentyl glycol
C6-2G: cyclohexanedimethanol

COMPARATIVE EXAMPLE 14

Polymerization and spinning were performed in the same manner as in Example 16 except that the ratio of TMG to 4G was changed. The results obtained are shown in Table 2. The ratio of 4G component was less than 10.3 wt % and Tmax of the fiber was 85° C. or less. The dye exhaustion was high but the color fastness to dry cleaning solvent was very poor and class 1.

COMPARATIVE EXAMPLE 15

Polymerization and spinning were performed in the same manner as in Example 16 except that hexamethylene glycol (hereinafter simply referred to as "6G") was used in place of 4G and the ratio of TMG to 6G was changed. The test and evaluation results of fiber obtained are shown in Table 2. The ratio of 6G component in the polymer was 8.7 wt % and Tmax of the fiber was 85° C. or less. When this fiber was dyed at 95° C. for 60 minutes, a dye exhaustion in excess of (hereinafter simply referred to as "2G") was used in place of 4G and the ratio of TMG to 2G was changed. The results obtained are shown in Table 2. The polymer obtained was colored yellow and the fiber obtained was also colored yellow as having a b value of 18.3 and could not be used for uses required to have whiteness, such as inner wear.

EXAMPLE 22

A warp knitted fabric was prepared using the polyester fiber of Example 16 and Loica of 210 denier (polyurethane-based stretch fiber, produced by Asahi Chemical Industry Co., Ltd.). The knitting gauge was 28 G, the loop length was 1,080 mm/480 course for polyester fiber and 112 mm/480 course for stretch fiber, and the driving density was 90 course/inch. The ratio of polyester fiber mixed was set to 75.5%.

The grey fabric obtained was subjected to relax scouring at 90° C. for 2 minutes and then to dry heatsetting at 160°

C. for 1 minute. Subsequently, the fabric was dyed at 95° C. for 60 minutes at a pH of 6 adjusted by acetic acid and at a liquor to goods ratio of 1:30 using 8% owf of Dianics Black BG-FS (disperse dye, produced by Dystar Japan) in the presence of 0.5 g/l of Niccasansolt 1200 as a dyeing aid.

The dyed product obtained had an L value for indicating the black brightness of 11.7, revealing satisfactory dyeing. Furthermore, the dyed product had color fastness to laundry of class 5, color fastness to rubbing in wet state of class 5 and color fastness to light of class 4 and exhibited soft, highly stretching and excellent touch with tensiness and resiliency.

COMPARATIVE EXAMPLE 18

For the purpose of comparison, a warp knitted fabric was prepared using nylon 6 fiber spun by a conventional process and Loica in the same manner as in Example 22 and dyed using 7% owf of Kayaron Black BGL (acid dye, produced by Nippon Kayaku Co., Ltd.) at 95° C. for 60 minutes. The dyed product obtained had an L value of 12.3 and this fabric had color fastness to light of class 2 to 3.

EXAMPLE 23

A plain weave woven fabric (warp density: 140 yarns/25.4 mm, weft: 80 yarns/25.4 nm) was prepared using a polyester fiber of 75 d/36 f obtained in the same manner as in Example 16 for warp yarns and cuprammonium rayon of 75 d/44 f for weft yarns. This plain weave woven fabric was scoured by a conventional process and then mercerized. The mercerization was performed by immersing the fabric in a 75% aqueous sodium hydroxide solution at an ordinary temperature. Thereafter, the fabric was neutralized, washed with water, preset at 180° C. for 30 seconds, and then subjected to one bath one step dyeing with a disperse dye and a reactive dye without using a carrier. The disperse dye used was Kayaron Polyester Blue BRSF (disperse dye, produced by Nippon Kayaku Co., Ltd.) and the reactive dye used was Drimarene Blue X-SGN (produced by Sandoz A. G.). The dyeing solution was prepared by adding the dyes to an aqueous solution having added thereto 50 g/l of sodium sulfate and 15 g/l of sodium carbonate and adjusted to a pH of 11, using 1 g/l of Disper TL (produced by Meisei Chemical Works Ltd.) as a dispersing agent. The dyeing was performed at a dye concentration of 2% owf, a liquor to goods ratio of 1:50 and 95° C. for 1 hour. After the dyeing, the fabric was soaped using 1 g/l of Gran Up P (nonionic surfactant, produced by Sanyo Chemical Industries Ltd.) at a liquor to goods ratio of 1:50 and 80° C. for 10 minutes. The dyed fabric was finished by a conventional process.

The dyed product obtained was uniformly dyed and had soft touch and dry feeling, which could not be attained by conventional woven fabrics. The dyed product had K/S of 22.7, color fastness to dry cleaning solvent of class 3, color fastness to rubbing in wet state of class 4, and color fastness to light of class 4.

Also, a plain weave woven fabric was manufactured using a polyester fiber of 75 d/36 f obtained in the same manner as in Example 16 for both the weft and warp yarns, and then dyed. The fabric obtained had no dry feeling but was extremely soft and exhibited stretchability of about 7% in the weft direction.

EXAMPLE 24

The polyester fiber of Example 16 was twisted at 300 T/m and starched by a roller. Using this fiber for warp yarns and using diacetate (100 d/150 f) for weft yarns, a plain weave woven fabric (warp: 120 yarns/25.4 mm, weft: 80 yarns/25.4 mm) was prepared.

The fabric was then subjected to one bath one step dyeing at 95° C. using Kayaron Polyester Blue 3RSF (produced by Nippon Kayaku Co., Ltd.) as a disperse dye for polyester fiber, and Kayaron Fast Blue RD200. (produced by Nippon Kayaku Co., Ltd.) as a disperse dye for diacetate, each at a dye concentration of 5% owf under weakly acidic conditions in the presence of a dispersing agent. After the dyeing, the fabric was soaped at 70° C. for 20 minutes in a weak alkali bath containing 1 g/l of soda ash and 0.5 g/l of nonionic detergent. The dyed product obtained was an excellent dyed product having K/S of 22.2. Furthermore, the dyed product had color fastness to dry cleaning solvent of class 3 to 4, color fastness to light of class 4, soft touch and excellent brilliance.

EXAMPLE 25

Using 1,170 parts by weight of DMT, 130 parts by weight of dimethyl isophthalate, 763 parts by weight of TMG and 1.3 parts by weight of titanium tetrabutoxide, an ester interchange reaction was performed at 220° C. Subsequently, 0.01 part by weight of trimethyl phosphate was added and polycondensed at 250° C. under reduced pressure of 0.5 torr to obtain a polymer. The polymer obtained had an intrinsic viscosity of 0.8. The isophthalic acid component in the polymer was measured by NMR and found to be 6.2 wt %.

The polymer chip obtained was dried and then spun at a spinning temperature of 265° C. and a spinning rate of 1,200 m/min using a spinneret having 36 orifices (diameter: 0.23 mm) each having a round cross section to prepare undrawn yarns. The undrawn yarns obtained were draw-twisted using a hot roll at 60° C. and a hot plate at 140° C. at a draw ratio of 2.9 times and a drawing rate of 600 m/min to obtain drawn yarns of 50 d/36 f. The fiber had physical properties such that the melting point was 219° C., Tmax was 100° C., the tenacity was 3.5 g/d, the elongation was 43%, U % was 1.0%, the modulus was 24 g/d, the elastic recovery was 82% and the b value was 7.6. The Q/R value of this fiber was 0.29 and satisfied formula (1). The polyester fiber obtained in this Example had a disperse dye exhaustion as high as 81% at 95° C. for 60 minutes. After the dyeing, a single end fed knitted fabric was produced and examined on the color fastness to dry cleaning solvent. Then, the dyed product did not fade and the solution staining was class 3. The dyed product also had good dyed color fastness such that the color fastness to light was class 4 to 5, the color fastness to rubbing in dry or wet state was class 5 and the color fastness to laundry was class 5.

EXAMPLES 26 TO 31

Polymerization and spinning were performed in the same manner as in Example 25 by varying the kind of dicarboxylic acid derivative. The evaluation results of fibers obtained are shown together in Table 3. In any case, the fiber satisfied formula (1) and exhibited excellent dyeability, high color fastness and good physical properties.

COMPARATIVE EXAMPLES 19 and 20

The experiment of Example 25 wasrepeated by varying the copolymerizing ratio of dimethyl isophthalate. The test and evaluation results of fibers obtained are shown together in Table 3. In Comparative Example 19, the fiber was inferior in the dyeability due to the excessively low copolymerizing ratio and in Comparative Example 20, the color fastness to dry cleaning solvent was reduced due to the excessively high copolymerizing ratio.

TABLE 3

| | Copolymerizing component | | Melting point | Intrinsic viscosity | Tenacity | Elongation | Modulus | Elastic recovery | | Tmax | U % | Dye exhaustion | CD Fastness | b |
|---|---|---|---|---|---|---|---|---|---|---|---|---|---|---|
| | kind | wt % | (° C.) | [η] | (g/d) | (%) | (g/d) | (%) | Q/R | ° C. | % | (%) | (class) | Value |
| Example 25 | dimethyl iso-phthalate | 6.2 | 219 | 0.80 | 3.5 | 43 | 24 | 82 | 0.29 | 100 | 1.0 | 81 | 3 | 7.6 |
| Example 26 | dimethyl iso-phthalate | 5.2 | 224 | 0.81 | 3.5 | 43 | 24 | 75 | 0.43 | 102 | 0.8 | 75 | 4 | 7.5 |
| Example 27 | dimethyl iso-phthalate | 7.4 | 216 | 0.75 | 3.4 | 42 | 20 | 83 | 0.25 | 96 | 1.0 | 91 | 3 | 7.3 |
| Example 28 | dimethyl succinate | 4.0 | 222 | 0.80 | 3.5 | 42 | 22 | 85 | 0.28 | 92 | 1.1 | 85 | 3 | 8.2 |
| Example 29 | dimethyl adipate | 5.3 | 222 | 0.77 | 3.5 | 41 | 23 | 90 | 0.23 | 89 | 1.2 | 96 | 3 | 9.6 |
| Example 30 | dimethyl sebacate | 7.8 | 210 | 0.80 | 3.0 | 44 | 22 | 86 | 0.19 | 85 | 1.1 | 96 | 3 | 9.5 |
| Example 31 | 1,4-cyclo-hexanedi-carboxylic acid | 6.0 | 220 | 0.80 | 2.2 | 42 | 23 | 87 | 0.21 | 85 | 1.2 | 90 | 3 | 9.0 |
| Comparative Example 19 | dimethyl iso-phthalate | 1.8 | 227 | 0.80 | 3.6 | 40 | 23 | 89 | 0.26 | 108 | — | 54 | 4 | 7.6 |
| Comparative Example 20 | dimethyl iso-phthalate | 12.3 | 225 | 0.80 | 2.4 | 54 | 19 | 70 | 0.27 | 69 | — | 96 | 1 | 7.6 |

REFERENCE EXAMPLE 2

The experiment of Example 29 was repeated except that trimethyl phosphite were not used. The physical properties of fiber were not changed but the fiber had a b value of 12.3, thus, slightly turned yellow.

EXAMPLE 32

A warp knitted fabric was prepared using the polyester fiber of Example 25 and Loica of 210 denier (polyurethane-based stretch fiber, produced by Asahi Chemical Industry Co., Ltd.). The knitting gauge was 28 GAG, the loop length was 1,080 mm/480 course for polyester fiber and 112 mm/480 course for stretch fiber, and the driving density was 90 course/inch. The ratio of polyester fiber mixed was set to 75.5%.

The grey fabric obtained was subjected to relax scouring at 90° C. for 2 minutes and then to dry heatsetting at 160° C. for 1 minute. Subsequently, the fabric was dyed at 95° C. for 60 minutes at a pH of 6 adjusted by acetic acid and at a liquor to goods ratio of 1:30 using 8% owf of Dianics Black BG-FS (disperse dye, produced by Dystar Japan) in the presence of 0.5 g/l of Niccasunsolt 1200 (produced by Nikka Chemical Co., Ltd.) as a dyeing aid.

The dyed product obtained had an L value for indicating the black brightness of 11.3, revealing satisfactory dyeing. Furthermore, the dyed product had color fastness to laundry of class 5, color fastness to rubbing in wet state of class 4 and color fastness to light of class 4 and exhibited soft, highly stretching and excellent touch with tensiness and resiliency.

EXAMPLE 33

Using 1,300 parts by weight of DMT, 1,121 parts by weight of TMG, 1.3 parts by weight of titanium tetrabutoxide and 0.01 part by weight of cobalt acetate, an ester interchange reaction was performed at 220° C.

Subsequently, 69 parts by weight of poly(ethylene glycol) having an average molecular weight of 1,000 and 0.01 part by weight of phosphoric acid were added and polycondensed at 260° C. under reduced pressure of 0.5 torr to obtain a polymer. The polymer obtained had an intrinsic viscosity of 0.82. The copolymerizing ratio of poly(ethylene glycol) having an average molecular weight of 1,000 was 5 wt %.

The polymer chip obtained was dried and then spun at a spinning temperature of 265° C. and a spinning rate of 1,200 m/min using a spinneret having 36 holes (diameter: 0.23 mm) each having a round cross section to prepare undrawn yarns. The undrawn yarns obtained were draw-twisted using a hot roll at 50° C. and a hot plate at 140° C. at a draw ratio of 2.9 times and a drawing rate of 600 m/min to obtain drawn yarns of 50 d/36 f. The fiber had physical properties such that the melting point was 232° C., Tmax was 92° C., the tenacity was 3.1 g/d, the elongation was 43%, U % was 1.1%, the modulus was 20 g/d, the elastic recovery was 89% and the,b value was 8.2. The Q/R value of this fiber was 0.22 and satisfied formula (1).

The polyester fiber obtained in this Example had a disperse dye exhaustion as high as 92% at 95° C. for 60 minutes.

After the dyeing, a single stitch knitted fabric was produced and examined on the color fastness to dry cleaning solvent. Then, the dyed product did not fade and the solution staining was class 2. The fiber also had good results with respect to the color fastness to light was (class 3), the color fastness to rubbing in dry or wet state (class 5) and the color fastness to laundry (class 5).

EXAMPLES 34 to 39

Polymerization and spinning were performed in the same manner as in Example 33 by varying the kind of poly (alkylene glycol). The test and evaluation results obtained are shown together in Table 4. In any Example, the fiber satisfied formula (1) and exhibited excellent dyeability, high color fastness and good physical properties.

COMPARATIVE EXAMPLES 21 and 22

The experiment of Example 33 was repeated by varying the copolymerizing ratio of polyethylene glycol). The results obtained are shown in Table 4. In Comparative Example 21, the dyeability was deficient due to the excessively low copolymerizing ratio and in Comparative Example 22, the color fastness to dry cleaning solvent was deteriorated due to the excessively high copolymerizing ratio. The whiteness of fiber was also reduced.

TABLE 4

| | Copolymerizing component | | | Melting | Intrinsic | Tenacity | Elongation | Modulus | Elastic | | | | Dye | CD | |
|---|---|---|---|---|---|---|---|---|---|---|---|---|---|---|---|
| | kind | molecular weight | wt % | point (° C.) | viscosity [η] | (g/d) | (%) | (g/d) | recovery (%) | Q/R | Tmax ° C. | U % % | exhaustion (%) | Fastness (class) | b Value |
| Example 33 | PEG | 1000 | 5 | 232 | 0.82 | 3.1 | 43 | 20 | 89 | 0.22 | 92 | 1.1 | 92 | 2 | 8.2 |
| Example 34 | PEG | 1000 | 3 | 232 | 0.82 | 3.5 | 39 | 23 | 89 | 0.26 | 101 | 1.1 | 70 | 3 | 8.5 |
| Example 35 | PEG | 1000 | 4 | 232 | 0.81 | 3.2 | 41 | 22 | 90 | 0.24 | 97 | 1.2 | 82 | 3 | 8.2 |
| Example 36 | PEG | 1000 | 10 | 230 | 0.84 | 2.8 | 45 | 19 | 87 | 0.22 | 86 | 1.1 | 99 | 2 | 9.7 |
| Example 37 | PEG | 3000 | 6 | 233 | 0.82 | 3.4 | 39 | 23 | 88 | 0.26 | 93 | 1.3 | 91 | 2 | 9.4 |
| Example 38 | PEG | 6000 | 10 | 230 | 0.79 | 3.3 | 39 | 21 | 88 | 0.24 | 100 | 1.5 | 71 | 2 | 9.8 |
| Example 39 | PTMG | 2000 | 5 | 233 | 0.78 | 3.6 | 40 | 21 | 91 | 0.25 | 96 | 1.1 | 88 | 2 | 8.3 |
| Comparative Example 21 | PEG | 1000 | 2 | 232 | 0.80 | 3.5 | 41 | 21 | 88 | 0.24 | 104 | — | 63 | 2 | 7.1 |
| Comparative Example 22 | PEG | 1000 | 12 | 226 | 0.84 | 2.5 | 42 | 18 | 85 | 0.21 | 79 | — | 99 | 1 | 11.5 |

PEG: poly(ethylene glycol)
PTMG: poly(tetramethylene glycol)

EXAMPLE 40

A warp knitted fabric was prepared using the polyester fiber of Example 33 and Loica of 210 denier (polyurethane-base stretch fiber, produced by Asahi Chemical Industry Co., Ltd.). The knitting conditions were set such that the gauge was 28 G, the loop length was 1,080 mm/480 course for polyester fiber and 112 mm/480 course for stretch fiber, and the driving density was 90 course/25.4 mm. The ratio of polyester fiber mixed was set to 75.5%.

The grey fabric obtained was subjected to relax scouring at 90° C. for 2 minutes and then to dry heatsetting at 160° C. for 1 minute. Subsequently, the fabric was dyed at 95° C. for 60 minutes at a pH of 6 adjusted by acetic acid and at a liquor to goods ratio of 1:30 using 8% owf of Dianics Black BG FS (produced by Dystar Japan) in the presence of 0.5 g/l of Niccasansolt 1200 as a dyeing aid.

The dyed product obtained had an L value for indicating the black brightness of 11.0, revealing satisfactory dyeing. The fiber had color fastness to laundry of class 5, color fastness to abrasion in wet state of class 4 and color fastness to light of class 4 and the dyed fabric exhibited soft, highly stretching and excellent touch with tensiness and resiliency.

EXAMPLE 41

Poly(trimethylene terephthalate) having an intrinsic viscosity of 0.9 and poly(butylene terephthalate) having an intrinsic viscosity of 1.0 were mixed at a ratio of 94.8:5.2 and the mixture was extruded as it was. Using this polymer mixture, a poly(trimethylene terephthalate) fiber was obtained by copolymerizing 5.2 wt % of 1,4-butane diol in the same manner as in Example 17.

The fiber obtained was almost equal to the fiber of Example 17 and had a tenacity of 3.6 g/d, an elongation of 43%, U % of 0.7%, a modulus of 23 g/d, an elastic recovery of 81%, a b value of 4.4, a Q/R value of 0.28, Tmax of 97° C. and a disperse dye exhaustion at 95° C. for 60 minutes of 84%

EXAMPLE 42

A plain weave woven fabric (warp: 40 yarns/25.4 mm, weft: 80 yarns/25.4 mm) was prepared using the polyester fiber of 75 d/36 f obtained in Example 1 for warp yarns and cuprammonium rayon of 75 d/44 f for weft yarns. This plain weave woven fabric was scoured by a conventional process, washed with water, preset at 180° C. for 30 seconds, and then subjected to one bath one step dyeing with a cationic dye and a reactive dye without using a carrier. Kyacryl Black BS-ED (cationic dye, produced by Nippon Kayaku Co., Ltd.) and Drimarene Blue X-SGN (reactive dye, produced by Sandoz A. G.) were used. The dyeing solution was prepared by adding the dyes to an aqueous solution having added thereto 50 g/l of sodium sulfate and 15 g/l of sodium carbonate and adjusted to a pH of 11, using 1 g/l of Disper TL (dispersing agent, produced by Meisei Chemical Works Ltd.). The dyeing was performed at a dye concentration of 2% owf, a liquor to goods ratio of 1:50 and 100° C. for 1 hour. After the dyeing, the fabric was soaped using 1 g/l of Gran Up P (produced by Sanyo Chemical Industries Ltd.) at a liquor to goods ratio of 1:50 and 80° C. for 10 minutes. The dyed fabric was finished by a conventional process.

The dyed product obtained was a uniformly dyed brilliant product having excellent color fastness against abrasion in wet state, against dry cleaning solvent and against light. Furthermore, despite omission of caustic reduction treatment commonly performed for polyester fibers, the touch was excellent having soft touch and dry feeling, which could not be attained by conventional woven fabrics.

Also, a plain weave woven fabric was manufactured using the polyester fiber of 75 d/36 f obtained in Example 1 for both the weft and warp yarns, and then dyed. The fabric obtained had no dry feeling but was extremely soft and exhibited stretchability of about 7% in the weft direction.

COMPARATIVE EXAMPLE 23

In Example 42, the dyeing was performed at a temperature of 130° C., then, the reactive dye was decomposed and the fabric was colored dark.

EXAMPLE 43

A plain weave woven fabric (warp: 140 yarns/3.54, weft: 80 yarns/25.4) was prepared using the polyester fiber of 75 d/36 f obtained in Example 1 for warp yarns and weft yarns. This plain weave woven fabric was scoured by a conventional process, treated for caustic reduction of 20% using a 10% aqueous sodium hydroxide solution, then preset and dyed in the same manner as in Example 42, and finally heatset at 180° C. for 30 seconds.

The fabric obtained was exhibited soft and dry feeling touch which could not be attained by conventional woven fabrics, and also exhibited stretchability of about 7% in the weft direction.

INDUSTRIAL APPLICABILITY

The poly(trimethylene terephthalate)-based fiber of the present invention can be substantially dyed into desired shade with either one or both of a cationic dye and a disperse dye under atmospheric pressure. In addition, the poly (trimethylene terephthalate)-based fiber of the present invention is a fiber material having wash-and-wear property, dimensional stability, good color fastness, dry touch feeling and suitability for caustic reduction treatment analogous to general-purpose polyester fiber, and also having softness analogous to nylon fiber.

By virtue of these capabilities, the poly(trimethylene terephthalate)-based fiber of the present invention is a fiber material suitable for the production of a fast dyed product from a composite fabric with a stretch fabric represented by polyurethane elastic fiber, a fiber material having low heat resistance such as wool, silk and acetate fiber, or a cellulose fiber dyeable under atmospheric pressure. Particularly in the case of a fabric product in mixture with the above-described fiber having low heat resistance, a fast dyed fabric can be produced by a simple dyeing method using a general-purpose atmospheric dyeing facility without impairing the properties of fiber and this is an industrially noteworthy effect of the present invention.

What is claimed is:

1. A polyester fiber comprising a copolyester of terephthalic acid, trimethylene glycol and an ester-forming sulfonate compound represented by formula (X), the ester-forming sulfonate compound being copolymerized in a molar ratio in a range from 0.5 to 5 mole % based on the total molar content of all acid compounds forming the copolyester,

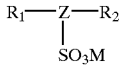

(X)

wherein $R_1$ and $R_2$, which are the same or different from each other, represent a group selected from the group consisting of —COOH, —COOR, —OCOR, —$(CH_2)_n$ OH, —$(CH_2)_n[O(CH_2)_m]_p$ OH and —$CO[O(CH_2)_n]_mOH$ (wherein R represents an alkyl group having from 1 to 10 carbon atoms, and n, m and p are each an integer of 1 or more), M represents a metal ion, $NH_4^+$ or a phosphonium group represented by $P^+R_3R_4R_5R_6$ (wherein $R_3$, $R_4$, $R_5$, and $R_6$ are the same or different and are each a group selected from the group consisting of a hydrogen atom, an alkyl group, an aryl group and a hydroxyalkyl group), and Z represents a trivalent organic group, from 0.01 to 0.07 weight % based on the weight of the copolyester of a color inhibitor selected from the group consisting of cobalt acetate and cobalt formate and from 0.01 to 0.07 weight % based on the weight of the copolyester of a thermal stabilizer comprising a pentavalent or a trivalent phosphorous compound, wherein the fiber has a degree of yellow tinting b value of from −2 to 10 and a peak temperature of loss tangent of from 85 to 115° C.; and the relationship between modulus Q (g/d) and elastic recovery R (%) of the fiber satisfies the following formula (1):

$$0.18 \leqq Q/R \leqq 0.45 \quad (1).$$

2. The polyester fiber of claim 1, wherein the ester-forming sulfonate compound represented by formula (X) is 5-sodium sulfoisophthalate, tetraalkyl phosphonium 3,5-dicaboxybenzene sulfonate or a mixture thereof.

3. The polyester fiber of claim 1, wherein a copolymerizing molar ratio of the ester-forming sulfonate compound as represented by formula (X) based on the total molar number of all acid compounds is from 1.2 to 2.5 mole %.

4. The polyester fiber of claim 1, wherein the ester-forming sulfonate compound as represented by formula (X) is 5-sodium sulfoisophthalate, tetraalkyl phosphonium 3,5-dicaboxybenzene sulfonate or a mixture thereof, and a copolymerizing molar ratio of the ester-forming sulfonate compound based on the total molar number of all acid compounds is from 1.2 to 2.5 mole %.

5. A polyester fiber comprising a copolyester obtained by copolymerizing terephthalic acid, trimethylene glycol and a compound selected from the group consisting of the following compounds (a), (b,) and (c):

(a) an aliphatic or alicyclic glycol having from 4 to 12 carbon atoms in a copolymerizing ratio of from 1.5 to 12% based on the weight of the copolyester;

(b) an aliphatic or alicyclic dicarboxylic acid having from 2 to 14 carbon atoms, or isophthalic acid in a copolymerizing ratio of from 3 to 9% based on the weight of the copolyester; and (c) a poly(alkylene glycol) in a copolymerizing ratio of from 3 to 10% based on the weight of the copolyester, from 0.01 to 0.07 weight % based on the weight of the copolyester of a color inhibitor selected from the group consisting of cobalt acetate and cobalt formate and from 0.01 to 0.07 weight % based on the weight of the copolyester of a thermal stabilizer comprising a pentavalent or a trivalent phosphorous compound, wherein the fiber has a degree of yellow tinting b value of from −2 to 10 and a peak temperature of loss tangent of from 85° C. to 102° C. and the relationship between modulus Q (g/d) and elastic recovery R (%) of the fiber satisfies the following formula (1):

$$0.18 \leqq Q/R \leqq 0.45 \quad (1).$$

6. A polyester fiber comprising a copolyester obtained by copolymerizing terephthalic acid, trimethylene glycol, an ester-forming sulfonate compound represented by the formula (X) in a range of from 1.2 to 2.5 mole % based on the total molar content of total acid compounds:

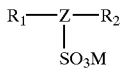

(X)

wherein $R_1$ and $R_2$, which are the same or different from each other, represent a group selected from the group consisting of —COOH, —COOR, —OCOR, —$(CH_2)_n$ OH, —$(CH_2)_n[O(CH_2)_m]_p$ OH and —$CO[O(CH_2)_n]_mOH$ (wherein R represents an alkyl group having from 1 to 10 carbon atoms, and n, m and p are each an integer of 1 or more), M represents a metal ion, $NH_4^+$ or a phosphonium group represented by $P^+R_3R_4R_5R_6$ (wherein $R_3$, $R_4$, $R_5$, and $R_6$ are the same or different and are each a group selected from the group consisting of a hydrogen atom, an alkyl group, an aryl group and a hydroxyalkyl group), and Z represents a trivalent organic group, and at least one compound in a range from 3 to 7% by weight based on the weight of the polyester selected from the group consisting of the following compounds (a), (b), and (c):

(a) an aliphatic or alicyclic glycol having from 4 to 12 carbon atoms;

(b) an aliphatic or alicyclic dicarboxylic acid having from 2 to 14 carbon atoms, or isophthalic acid; and (c) poly(alkylene glycol), from 0.01 to 0.07 weight % based on the weight of the copolyester of a color inhibitor selected from the group consisting of cobalt acetate and cobalt formate and from 0.01 to 0.07 weight % based on the weight of the copolyester of a thermal stabilizer comprising a pentavalent or a trivalent phosphorous compound, wherein the fiber has a degree of yellow tinting b value of from −2 to 10 and a peak temperature of loss tangent of from 85° C. to 115° C. and the relationship between modulus Q (g/d) and elastic recovery R (%) of the fiber satisfies the following formula (1):

$$0.18 \leqq Q/R \leqq 0.45 \quad (1).$$

7. A fabric partly or entirely comprising the polyester fiber of any one of claims 1, 5, and 6.

8. A fabric comprising the polyester fiber of any one of claims 1, 5, and 6 in combination with stretch fiber.

9. A fabric partly or entirely comprising the polyester fiber of any one of claims 1, 5, and 6 that is capable of being dyed with a cationic dye, a disperse dye, or a mixture thereof.

10. A polyester resin comprising a copolyester obtained by copolymerizing terephthalic acid, trimethylene glycol, and an ester-forming sulfonate compound represented by formula (X), the ester-forming sulfonate compound being copolymerized in a molar ratio in a range from 0.5 to 5 mole % based on the total molar content of total acid compounds forming the copolyester;

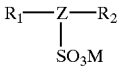

(X)

wherein $R_1$ and $R_2$, which are the same or different from each other, represent a group selected from the group consisting of —COOH, —COOR, —OCOR, —$(CH_2)_n$ OH, —$(CH_2)_n[O(CH_2)_m]_p$ OH and —$CO[O(CH_2)_n]_mOH$ (wherein R represents an alkyl group having from 1 to 10 carbon atoms, and n, m and p are each an integer of 1 or more), M represents a metal ion, $NH_4^+$ or a phosphonium group represented by $P^+R_3R_4R_5R_6$ (wherein $R_3$, $R_4$, $R_5$, and $R_6$ are the same or different and are each a group selected from the group consisting of a hydrogen atom, an alkyl group, an aryl group and a hydroxyalkyl group), and Z represents a trivalent organic group, from 0.01 to 0.07 weight % based on the weight of the copolyester of a color inhibitor selected from the group consisting of cobalt acetate and cobalt formate and from 0.01 to 0.07 weight % based on the weight of the copolyester of a thermal stabilizer comprising a pentavalent or a trivalent phosphorous compound, wherein the resin has an intrinsic viscosity of 0.4 to 1.2; and has a degree of yellow tinting b value of −2 to 10.

11. A polyester resin comprising a copolyester obtained by copolymerizing terephthalic acid, trimethylene glycol, an ester-forming sulfonate compound represented by formula (X), the ester-forming sulfonate compound being copolymerized in a molar ratio in a range from 1.2 to 2.5 mole % based on the total molar content of all the acid compounds forming the copolyester;

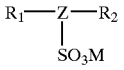

(X)

wherein $R_1$ and $R_2$, which are the same or different from each other, represent a group selected from the group consisting of —COOH, —COOR, —OCOR, —$(CH_2)_n$ OH, —$(CH_2)_n[O(CH_2)_m]_p$ OH and —$CO[O(CH_2)_n]_mOH$ (wherein R represents an alkyl group having from 1 to 10 carbon atoms, and n, m and p are each an integer of 1 or more), M represents a metal ion, $NH_4^+$ or a phosphonium group represented by $P^+R_3R_4R_5R_6$ (wherein $R_3$, $R_4$, $R_5$, and $R_6$ are the same or different and are each a group selected from the group consisting of a hydrogen atom, an alkyl group, an aryl group and a hydroxyalkyl group), and Z represents a trivalent organic group, and at least one compound in a range from 3 to 7% by weight based on the weight of the copolyester selected from the group consisting of the following compounds (a), (b) and (c):

(a) an aliphatic or alicyclic glycol having from 4 to 12 carbon atoms;

(b) an aliphatic or alicyclic dicarboxylic acid having from 2 to 14 carbon atoms, or isophthalic acid; and (c) poly(alkylene glycol), from 0.01 to 0.07 weight % based on the weight of the copolyester of a color inhibitor selected from the group consisting of cobalt acetate and cobalt formate and from 0.01 to 0.07 weight % based on the weight of the copolyester of a thermal stabilizer comprising a pentavalent or a trivalent phosphorous compound, wherein the resin has an intrinsic viscosity of 0.4 to 1.2; and has a degree of yellow tinting b value of −2 to 10.

12. The polyester resin of claim 10 or 11, including at least one compound selected from basic metal salts in a ratio of from 20 to 400 mole % based on the content of the ester-forming sulfonate compound.

13. The polyester resin of claim 12, wherein the basic metal salt is a sodium salt, potassium salt or a calcium salt.

14. A polyester resin comprising a copolyester obtained by copolymerizing terephthalic acid, trimethylene glycol, and a compound selected from the group consisting of the following compounds (a), (b), and (c):

(a) an aliphatic or alicyclic glycol having from 4 to 12 carbon atoms in a copolymerizing ratio of from 1.5 to 12% based on the weight of the copolyester;

(b) an aliphatic or alicyclic dicarboxylic acid having from 2 to 14 carbon atoms, or isophthalic acid in a copolymerizing ratio of from 3 to 10% by weight based on the weight of the copolyester; and (c) a poly(alkylene glycol) in a copolymerizing ratio of from 3 to 10% by weight based on the weight of the copolyester, from 0.01 to 0.07 weight % based on the weight of the copolyester of a color inhibitor selected from the group consisting of cobalt acetate and cobalt formate and from 0.01 to 0.07 weight % based on the weight of the copolyester of a thermal stabilizer comprising a pentavalent or a trivalent phosphorous compound, wherein the resin has an intrinsic viscosity of 0.4 to 1.2; and has a degree of yellow tinting b value of −2 to 10.

* * * * *